US007889222B2

(12) United States Patent
Koizumi et al.

(10) Patent No.: US 7,889,222 B2
(45) Date of Patent: Feb. 15, 2011

(54) LENS ARRAY FOR A LINE HEAD, A LINE HEAD AND AN IMAGE FORMING APPARATUS

(75) Inventors: Ryuta Koizumi, Shiojiri (JP); Yujiro Nomura, Shiojiri (JP); Takeshi Sowa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 36 days.

(21) Appl. No.: 12/362,382

(22) Filed: Jan. 29, 2009

(65) Prior Publication Data

US 2009/0195634 A1 Aug. 6, 2009

(30) Foreign Application Priority Data

Feb. 1, 2008 (JP) ..... 2008-022638
Dec. 18, 2008 (JP) ..... 2008-321937

(51) Int. Cl.
*B41J 15/14* (2006.01)
*B41J 27/00* (2006.01)

(52) U.S. Cl. ..... 347/244; 347/258

(58) Field of Classification Search ..... 347/238, 347/244, 258; 359/721
See application file for complete search history.

(56) References Cited

U.S. PATENT DOCUMENTS 6,538,682 B2 * 3/2003 Ohkubo ..... 347/241
6,961,185 B2 * 11/2005 Suehiro et al. ..... 359/620
2005/0151828 A1 * 7/2005 Maeda ..... 347/238
2005/0213222 A1 9/2005 Kishima et al.
2007/0017993 A1 1/2007 Sander
2008/0290383 A1 11/2008 Dunne et al.

FOREIGN PATENT DOCUMENTS

EP 1 661 718 A2 5/2006
FR 2 894 035 A1 6/2007
JP 02-004546 1/1990
JP 11-215303 A 8/1999
JP 2005-276849 10/2005

* cited by examiner

*Primary Examiner*—Hai C Pham
(74) *Attorney, Agent, or Firm*—DLA Piper LLP (US)

(57) ABSTRACT

A line head, includes: a head substrate that includes a first light emitting element and a second light emitting element; and a lens array that includes a first positive lens that images a light emitted from the first light emitting element on a specified plane and has a lens surface of a free-form surface, and a second positive lens that images a light emitted from the second light emitting element on the specified plane and has a lens surface of a free-form surface, each of the lens surfaces of the first and the second positive lenses having focal points with different focal lengths.

8 Claims, 29 Drawing Sheets

CROSS SECTIONAL VIEW ALONG LINE A-A

LGD
LTD
PTE
PTE
PTE
PTE
295R
295R
295R
295
295
295

FIG. 21

OPTICAL DATA

| ITEM | VALUE |
|---|---|
| WAVELENGTH | 690 nm |
| DIAMETER OF PHOTOSENSITIVE MEMBER | $\phi$ 40 mm |

FIG. 22

DATA OF OPTICAL SYSTEMS INCLUDING LENSES LS-m

| SURFACE NUMBER | SURFACE TYPE | CURVATURE RADIUS | SURFACE INTERVAL [mm] | REFRACTIVE INDEX | ABBE CONSTANT |
|---|---|---|---|---|---|
| S1 (OBJECT PLANE) | | ∞ | 0.55 | $n_d$=1.5168 | $\nu_d$=64.2 |
| S2 | | ∞ | 4.284 | | |
| S3 (APERTURE) | | ∞ | 0.01 | | |
| S4 | 3AREA, ASPHERIC | SEE FIG. 25 | 0.27 | $n_d$=1.53 | $\nu_d$=50.8 |
| S5 | | ∞ | 0.9 | $n_d$=1.541 | $\nu_d$=57 |
| S6 | | ∞ | 1.428 | | |
| S7 | x-y POLYNOMIAL SURFACE | SEE FIG. 26 | 0.3 | $n_d$=1.53 | $\nu_d$=50.8 |
| S8 | | ∞ | 0.9 | $n_d$=1.541 | $\nu_d$=57 |
| S9 | | ∞ | 0.976 | | |
| S10 (IMAGE PLANE) | | ∞ | | | |

FIG. 23

●DEFINITION OF ASPHERICAL SURFACE
EQUALITIES BELOW ARE USED $$Z = \frac{(CURV)h^2}{1+\sqrt{1-(1+K)(CURV)^2h^2}} + (A)h^4$$

WHERE
z : SAG OF SURFACE PARALLEL TO z-AXIS
CURV: CURVATURE AT TOP OF SURFACE
k : CONIC COEFFICIENT
A : DEFORMATION COEFFICIENT OF FOURTH-ORDER
$h^2 = x^2+y^2$
x : x-AXIS (MAIN SCANNING DIRECTION) COORDINATE
y : y-AXIS (SUB SCANNING DIRECTION) COORDINATE

FIG. 24

●DEFINITION OF x-y POLYNOMIAL SURFACE
EQUALITIES BELOW ARE USED $$z(x,y) = \frac{cr^2}{1+\sqrt{1-(1+k)c^2r^2}} + \sum_{j=2}^{66} C_j x^n y^m$$

$$j = [(m+n)^2 + m + 3n]/2 + 1$$

WHERE
z: SAG OF SURFACE PARALLEL TO z-AXIS
c: CURVATURE AT TOP OF SURFACE
k: CONIC COEFFICIENT
Cj: COEFFICIENT OF MONOMIAL $x^m y^n$
x: x-AXIS (MAIN SCANNING DIRECTION) COORDINATE
y: y-AXIS (SUB SCANNING DIRECTION) COORDINATE

FIG. 25

VALUES OF COEFFICIENTS EXPRESSING SURFACES S4 OF OPTICAL SYSTEMS INCLUDING LENSES LS-m

| AREA IN LENS SURFACE | CURV | K | A |
|---|---|---|---|
| FIRST AREA | 0.63982 | -0.90038 | -4.558E-03 |
| SECOND AREA | 0.64513 | -0.39416 | -2.1588E-02 |
| THIRD AREA | 0.63370 | -0.82047 | -5.0937E-03 |

FIG. 26

VALUES OF COEFFICIENTS EXPRESSING SURFACES
S7 OF OPTICAL SYSTEMS INCLUDING LENSES LS-m

| NAME OF COEFFICIENT | | VALUE | NAME OF COEFFICIENT | | VALUE |
|---|---|---|---|---|---|
| CURVATURE c | | 0.77946 | | | |
| CONIC CONSTANT k | | -1.10716 | C34 | $x^2y^5$ | 0 |
| C2 | $x$ | 0 | C35 | $xy^6$ | 0 |
| C3 | $y$ | 0 | C36 | $y^7$ | 0 |
| C4 | $x^2$ | -2.2775E-03 | C37 | $x^8$ | 0 |
| C5 | $xy$ | 0 | C38 | $x^7y$ | 0 |
| C6 | $y^2$ | -4.7416E-03 | C39 | $x^6y^2$ | 0 |
| C7 | $x^3$ | 0 | C40 | $x^5y^3$ | 0 |
| C8 | $x^2y$ | 0 | C41 | $x^4y^4$ | 0 |
| C9 | $xy^2$ | 0 | C42 | $x^3y^5$ | 0 |
| C10 | $y^3$ | 0 | C43 | $x^2y^6$ | 0 |
| C11 | $x^4$ | 5.4543E-03 | C44 | $xy^7$ | 0 |
| C12 | $x^3y$ | 0 | C45 | $y^8$ | 0 |
| C13 | $x^2y^2$ | -1.2128E-03 | C46 | $x^9$ | 0 |
| C14 | $xy^3$ | 0 | C47 | $x^8y$ | 0 |
| C15 | $y^4$ | 8.9021E-04 | C48 | $x^7y^2$ | 0 |
| C16 | $x^5$ | 0 | C49 | $x^6y^3$ | 0 |
| C17 | $x^4y$ | 0 | C50 | $x^5y^4$ | 0 |
| C18 | $x^3y^2$ | 0 | C51 | $x^4y^5$ | 0 |
| C19 | $x^2y^3$ | 0 | C52 | $x^3y^6$ | 0 |
| C20 | $xy^4$ | 0 | C53 | $x^2y^7$ | 0 |
| C21 | $y^5$ | 0 | C54 | $xy^8$ | 0 |
| C22 | $x^6$ | -2.6926E-02 | C55 | $y^9$ | 0 |
| C23 | $x^5y$ | 0 | C56 | $x^{10}$ | 0 |
| C24 | $x^4y^2$ | -6.7148E-02 | C57 | $x^9y$ | 0 |
| C25 | $x^3y^3$ | 0 | C58 | $x^8y^2$ | 0 |
| C26 | $x^2y^4$ | -8.6562E-02 | C59 | $x^7y^3$ | 0 |
| C27 | $xy^5$ | 0 | C60 | $x^6y^4$ | 0 |
| C28 | $y^6$ | -0.0218 | C61 | $x^5y^5$ | 0 |
| C29 | $x^7$ | 0 | C62 | $x^4y^6$ | 0 |
| C30 | $x^6y$ | 0 | C63 | $x^3y^7$ | 0 |
| C31 | $x^5y^2$ | 0 | C64 | $x^2y^8$ | 0 |
| C32 | $x^4y^3$ | 0 | C65 | $xy^9$ | 0 |
| C33 | $x^3y^4$ | 0 | C66 | $y^{10}$ | 0 |

FIG. 27

DATA OF OPTICAL SYSTEMS INCLUDING LENSES LS-u, LS-d

| SURFACE NUMBER | SURFACE TYPE | CURVATURE RADIUS | SURFACE INTERVAL [mm] | REFRACTIVE INDEX | ABBE CONSTANT |
|---|---|---|---|---|---|
| S1 (OBJECT PLANE) | | ∞ | 0.55 | $n_d$=1.5168 | $\nu_d$=64.2 |
| S2 | | ∞ | 4.206 | | |
| S3 (APERTURE) | | ∞ | 0.04 | | |
| S4 | 3AREA, ASPHERIC | SEE FIG. 28 | 0.25 | $n_d$=1.53 | $\nu_d$=50.8 |
| S5 | | ∞ | 0.9 | $n_d$=1.541 | $\nu_d$=57 |
| S6 | | ∞ | 1.403 | | |
| S7 | x-y POLYNOMIAL SURFACE | SEE FIG. 29 | 0.28 | $n_d$=1.53 | $\nu_d$=50.8 |
| S8 | | ∞ | 0.9 | $n_d$=1.541 | $\nu_d$=57 |
| S9 | | ∞ | 0.957 | | |
| S10 (IMAGE PLANE) | | ∞ | | | |

FIG. 28

VALUES OF COEFFICIENTS EXPRESSING SURFACES S4 OF OPTICAL SYSTEMS INCLUDING LENSES LS-u, LS-d

| AREA IN LENS SURFACE | CURV | K | A |
|---|---|---|---|
| FIRST AREA | 0.66524 | -1.31757 | 1.0344E-02 |
| SECOND AREA | 0.66965 | -0.60017 | -1.6260E-02 |
| THIRD AREA | 0.65901 | -1.2100 | 7.2691E-03 |

FIG. 29

VALUES OF COEFFICIENTS EXPRESSING SURFACES S7 OF OPTICAL SYSTEMS INCLUDING LENSES LS-u, LS-d

| NAME OF COEFFICIENT | | VALUE | NAME OF COEFFICIENT | | VALUE |
|---|---|---|---|---|---|
| CURVATURE c | | 0.70753 | | | |
| CONIC CONSTANT k | | -3.89460 | C34 | $x^2y^5$ | 0 |
| C2 | $x$ | 0 | C35 | $xy^6$ | 0 |
| C3 | $y$ | 0 | C36 | $y^7$ | 0 |
| C4 | $x^2$ | 0.039599 | C37 | $x^8$ | 0 |
| C5 | $xy$ | 0 | C38 | $x^7y$ | 0 |
| C6 | $y^2$ | 0.035508 | C39 | $x^6y^2$ | 0 |
| C7 | $x^3$ | 0 | C40 | $x^5y^3$ | 0 |
| C8 | $x^2y$ | 0 | C41 | $x^4y^4$ | 0 |
| C9 | $xy^2$ | 0 | C42 | $x^3y^5$ | 0 |
| C10 | $y^3$ | 0 | C43 | $x^2y^6$ | 0 |
| C11 | $x^4$ | 1.1257E-01 | C44 | $xy^7$ | 0 |
| C12 | $x^3y$ | 0 | C45 | $y^8$ | 0 |
| C13 | $x^2y^2$ | 0.2034097 | C46 | $x^9$ | 0 |
| C14 | $xy^3$ | 0 | C47 | $x^8y$ | 0 |
| C15 | $y^4$ | 0.1094741 | C48 | $x^7y^2$ | 0 |
| C16 | $x^5$ | 0 | C49 | $x^6y^3$ | 0 |
| C17 | $x^4y$ | 0 | C50 | $x^5y^4$ | 0 |
| C18 | $x^3y^2$ | 0 | C51 | $x^4y^5$ | 0 |
| C19 | $x^2y^3$ | 0 | C52 | $x^3y^6$ | 0 |
| C20 | $xy^4$ | 0 | C53 | $x^2y^7$ | 0 |
| C21 | $y^5$ | 0 | C54 | $xy^8$ | 0 |
| C22 | $x^6$ | -0.07921190 | C55 | $y^9$ | 0 |
| C23 | $x^5y$ | 0 | C56 | $x^{10}$ | 0 |
| C24 | $x^4y^2$ | -0.2126654 | C57 | $x^9y$ | 0 |
| C25 | $x^3y^3$ | 0 | C58 | $x^8y^2$ | 0 |
| C26 | $x^2y^4$ | -0.2376198 | C59 | $x^7y^3$ | 0 |
| C27 | $xy^5$ | 0 | C60 | $x^6y^4$ | 0 |
| C28 | $y^6$ | -0.0781159 | C61 | $x^5y^5$ | 0 |
| C29 | $x^7$ | 0 | C62 | $x^4y^6$ | 0 |
| C30 | $x^6y$ | 0 | C63 | $x^3y^7$ | 0 |
| C31 | $x^5y^2$ | 0 | C64 | $x^2y^8$ | 0 |
| C32 | $x^4y^3$ | 0 | C65 | $xy^9$ | 0 |
| C33 | $x^3y^4$ | 0 | C66 | $y^{10}$ | 0 |

LENS ARRAY FOR A LINE HEAD, A LINE HEAD AND AN IMAGE FORMING APPARATUS

CROSS REFERENCE TO RELATED APPLICATION

The disclosure of Japanese Patent Applications No. 2008-22638 filed on Feb. 1, 2008 and No. 2008-321937 filed on Dec. 18, 2008 including specification, drawings and claims is incorporated herein by reference in its entirety.

BACKGROUND

1. Technical Field

This invention relates to a line head for imaging lights emitted from a first light emitting element and a second light emitting element on a specified plane by a first lens and a second lens respectively, an image forming apparatus using the line head and a lens array suitable for the line head.

2. Related Art

As disclosed, for example, in JP-A-2-4546, there has been proposed a lens array in which a plurality of lenses are arranged. Such a lens array can be used in a line head (optical information writing device in JP-A-2-4546) for imaging light beams from light emitting elements on an image plane. In other words, in the line head of JP-A-2-4546, a lens is provided for each light emitting element group formed by grouping a plurality of light emitting elements, and lights incident on the lens from the light emitting element group are imaged to form spots on the image plane.

SUMMARY

In the device disclosed in JP-A-2-4546, the lens array constituting the line head is arranged to be proximate to and face a photosensitive member. Thus, if a distance between the lens array and the photosensitive member deviates from a predetermined value, it becomes difficult to satisfactorily form spots on a surface of the photosensitive member. Further, in the case where distances to the photosensitive member surface differ from each other among the lenses constituting the lens array, even if some of the spots can be satisfactorily formed, it is difficult to satisfactorily form the remaining spots. In the case of image formation using such a line head, image quality is deteriorated.

An advantage of some aspects of the invention is to provide a line head capable of satisfactorily forming a plurality of spots on a specified plane, an image forming apparatus capable of forming a high-quality image using the line head and a lens array suitably used for the line head.

According to a first aspect of the invention, there is provided a line head, comprising: a head substrate that includes a first light emitting element and a second light emitting element; and a lens array that includes a first positive lens that images a light emitted from the first light emitting element on a specified plane and has a lens surface of a free-form surface, and a second positive lens that images a light emitted from the second light emitting element on the specified plane and has a lens surface of a free-form surface, each of the lens surfaces of the first and the second positive lenses having focal points with different focal lengths.

According to a second aspect of the invention, there is provided an image forming apparatus, comprising: a latent image carrier on which a latent image is formed; a head substrate that includes a first light emitting element and a second light emitting element; and a lens array that includes a first positive lens that images a light emitted from the first light emitting element on the latent image carrier and has a lens surface of a free-form surface, and a second positive lens that images a light emitted from the second light emitting element on the latent image carrier and has a lens surface of a free-form surface, each of the lens surfaces of the first and the second positive lenses having focal points with different focal lengths.

According to a third aspect of the invention, there is provided a lens array for a line head, comprising: a first positive lens that images a light emitted from a light emitting element on a specified plane and has a lens surface of a free-form surface; and a second positive lens that images a light emitted from a light emitting element different from the light emitting element on the specified plane and has a lens surface of a free-form surface, wherein each of the lens surfaces of the first and the second positive lenses has focal points with different focal lengths.

In the invention (lens array for line head, line head, image forming apparatus) thus constructed, lights emitted from the first and the second light emitting elements are imaged on the specified surface such as a latent image carrier surface by the first and the second positive lenses, respectively. In this way, spots are formed on the specified plane. A distance between the lens array and the specified plane may vary or distances between the first and second positive lenses and the specified plane may differ. If the first and second positive lenses are single focal lenses as in the related art, the positions and shapes of spots change and spots cannot be satisfactorily formed on the specified plane if the above distance variation and/or distance differences occur. However, in the invention, the first and second positive lenses have the lens surfaces of free-form surfaces and each of the lens surfaces has mutually different focal points. Accordingly, lights emitted from the respective light emitting elements are imaged at positions near the specified plane. As a result, even if the above distance variation and/or distance differences occur, good spots can be formed on the specified plane.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIG. 21 is a table showing optical system specifications in this example.

FIG. 22 is a table showing data of the optical system including the middle lens.

FIG. 23 is a diagram showing a definition formula of the aspherical surface.

FIG. 24 is a diagram showing a definition formula for the XY polynomial surface.

FIG. 25 is a table showing coefficient values of the surface S4 of the optical system including the middle lens.

FIG. 26 is a table showing coefficient values of the surface S7 of the optical system including the middle lens.

FIG. 27 is a table showing data of the optical systems including the upstream and downstream lenses.

FIG. 28 is a table showing coefficient values of the surfaces S4 of the optical systems including the upstream and downstream lenses.

FIG. 29 is a table showing coefficient values of the surfaces S7 of the optical systems including the upstream and downstream lenses.

DESCRIPTION OF EXEMPLARY EMBODIMENTS

Terms used in this specification are first described below (see "A. Description of Terms"). Following this description of terms, embodiments of the invention (see "B. First Embodiment" and the like) are described.

A. DESCRIPTION OF TERMS

Figure 1:
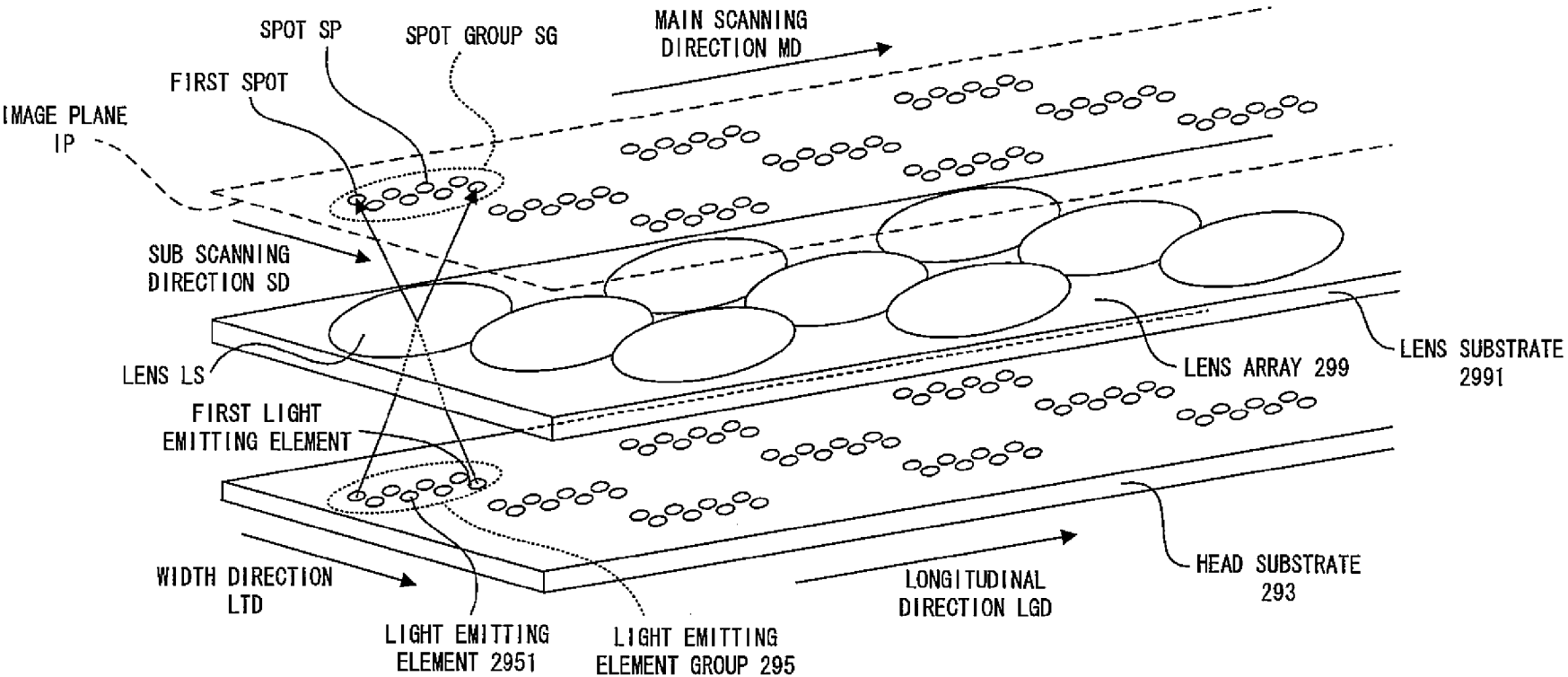
FIGS. 1 and 2 are diagrams showing terminology used in this specification.
Figure 2:
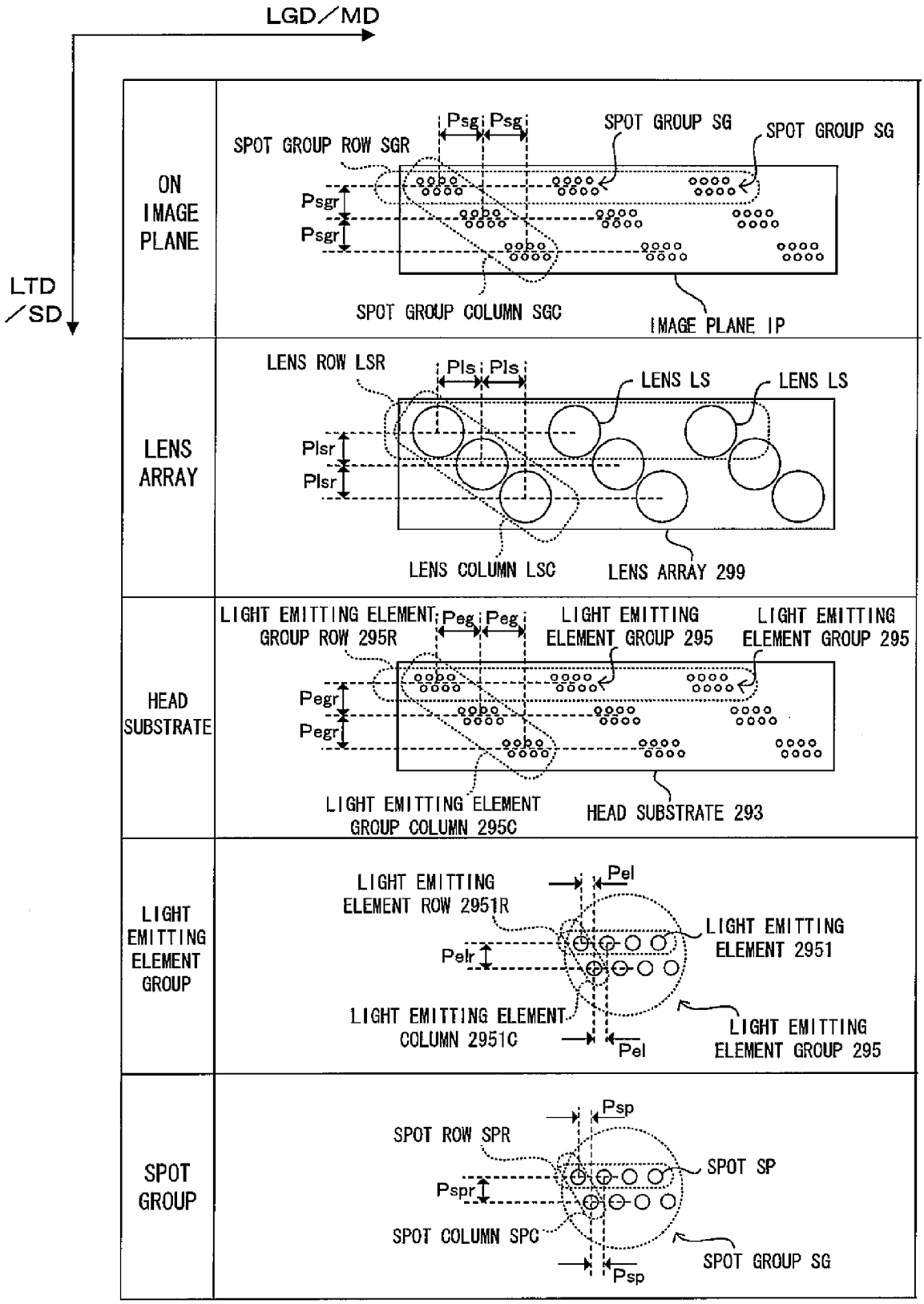

FIGS. 1 and 2 are diagrams showing terminology used in this specification. Here, terminology used in this specification is organized with reference to FIGS. 1 and 2. In this specification, a conveying direction of a surface (image plane IP) of a photosensitive drum 21 is defined to be a sub scanning direction SD and a direction orthogonal to or substantially orthogonal to the sub scanning direction SD is defined to be a main scanning direction MD. Further, a line head 29 is arranged relative to the surface (image plane IP) of the photosensitive drum 21 such that its longitudinal direction LGD corresponds to the main scanning direction MD and its width direction LTD corresponds to the sub scanning direction SD.

Collections of a plurality of (eight in FIGS. 1 and 2) light emitting elements 2951 arranged on a head substrate 293 in one-to-one correspondence with a plurality of lenses LS of a lens array 299 are defined to be light emitting element groups 295. In other words, in the head substrate 293, the plurality of light emitting element groups 295 including a plurality of light emitting elements 2951 are arranged in conformity with the plurality of lenses LS, respectively. Further, collections of a plurality of spots SP formed on the image plane IP by light beams from the light emitting element groups 295 imaged on the image plane IP by the lenses LS corresponding to the light emitting element groups 295 are defined to be spot groups SG. In other words, a plurality of spot groups SG can be formed in one-to-one correspondence with the plurality of light emitting element groups 295. In each spot group SG, the most upstream spot in the main scanning direction MD and the sub scanning direction SD is particularly defined to be a first spot. The light emitting element 2951 corresponding to the first spot is particularly defined to be a first light emitting element.

A spot group row SGR and a spot group column SGC are defined as shown in the column "On Image Plane" of FIG. 2. Specifically, a plurality of spot groups SG arranged in the main scanning direction MD are defined as the spot group row SGR. A plurality of spot group rows SGR are arranged at specified spot group row pitches Psgr in the sub scanning direction SD. Further, a plurality of (three in FIG. 2) spot groups SG arranged at spot group row pitches Psgr in the sub scanning direction SD and at spot group pitches Psg in the main scanning direction MD are defined as the spot group column SGC. The spot group row pitch Psgr is a distance in the sub scanning direction SD between the geometric centers of gravity of two spot group rows SGR adjacent in the sub scanning direction SD, and the spot group pitch Psg is a distance in the main scanning direction MD between the geometric centers of gravity of two spot groups SG adjacent in the main scanning direction MD.

Lens rows LSR and lens columns LSC are defined as shown in the column of "Lens Array" of FIG. 2. Specifically, a plurality of lenses LS aligned in the longitudinal direction LGD is defined to be the lens row LSR. A plurality of lens rows LSR are arranged at specified lens row pitches Plsr in the width direction LTD. Further, a plurality of (three in FIG. 2) lenses LS arranged at the lens row pitches Plsr in the width direction LTD and at lens pitches Pls in the longitudinal direction LGD are defined to be the lens column LSC. It should be noted that the lens row pitch Plsr is a distance in the width direction LTD between the geometric centers of gravity of two lens rows LSR adjacent in the width direction LTD, and that the lens pitch Pls is a distance in the longitudinal direction LGD between the geometric centers of gravity of two lenses LS adjacent in the longitudinal direction LGD.

Light emitting element group rows 295R and light emitting element group columns 295C are defined as in the column "Head Substrate" of FIG. 2. Specifically, a plurality of light emitting element groups 295 aligned in the longitudinal direction LGD is defined to be the light emitting element group row 295R. A plurality of light emitting element group rows 295R are arranged at specified light emitting element group row pitches Pegr in the width direction LTD. Further, a plurality of (three in FIG. 2) light emitting element groups 295 arranged at the light emitting element group row pitches Pegr in the width direction LTD and at light emitting element group pitches Peg in the longitudinal direction LGD are defined to be the light emitting element group column 295C. It should be noted that the light emitting element group row pitch Pegr is a distance in the width direction LTD between the geometric centers of gravity of two light emitting element group rows 295R adjacent in the width direction LTD, and that the light emitting element group pitch Peg is a distance in the longitudinal direction LGD between the geometric centers of gravity of two light emitting element groups 295 adjacent in the longitudinal direction LGD.

Light emitting element rows 2951R and light emitting element columns 2951C are defined as in the column "Light Emitting Element Group" of FIG. 2. Specifically, in each light emitting element group 295, a plurality of light emitting elements 2951 aligned in the longitudinal direction LGD is defined to be the light emitting element row 2951R. A plurality of light emitting element rows 2951R are arranged at specified light emitting element row pitches Pelf in the width direction LTD. Further, a plurality of (two in FIG. 2) light emitting elements 2951 arranged at the light emitting element row pitches Pelr in the width direction LTD and at light emitting element pitches Pel in the longitudinal direction LGD are defined to be the light emitting element column 2951C. It should be noted that the light emitting element row pitch Pelr is a distance in the width direction LTD between the geometric centers of gravity of two light emitting element rows 2951R adjacent in the width direction LTD, and that the light emitting element pitch Pel is a distance in the longitudinal direction LGD between the geometric centers of gravity of two light emitting elements 2951 adjacent in the longitudinal direction LGD.

Spot rows SPR and spot columns SPC are defined as shown in the column "Spot Group" of FIG. 2. Specifically, in each spot group SG, a plurality of spots SP aligned in the longitudinal direction LGD is defined to be the spot row SPR. A plurality of spot rows SPR are arranged at specified spot row pitches Pspr in the width direction LTD. Further, a plurality of (two in FIG. 2) spots arranged at the spot row pitches Pspr in the width direction LTD and at spot pitches Psp in the longitudinal direction LGD are defined to be the spot column SPC. It should be noted that the spot row pitch Pspr is a distance in the sub scanning direction SD between the geometric centers of gravity of two spot rows SPR adjacent in the sub scanning direction SD, and that the spot pitch Psp is a distance in the main scanning direction MD between the geometric centers of gravity of two spots SP adjacent in the main scanning direction MD.

B. FIRST EMBODIMENT

Figure 3:
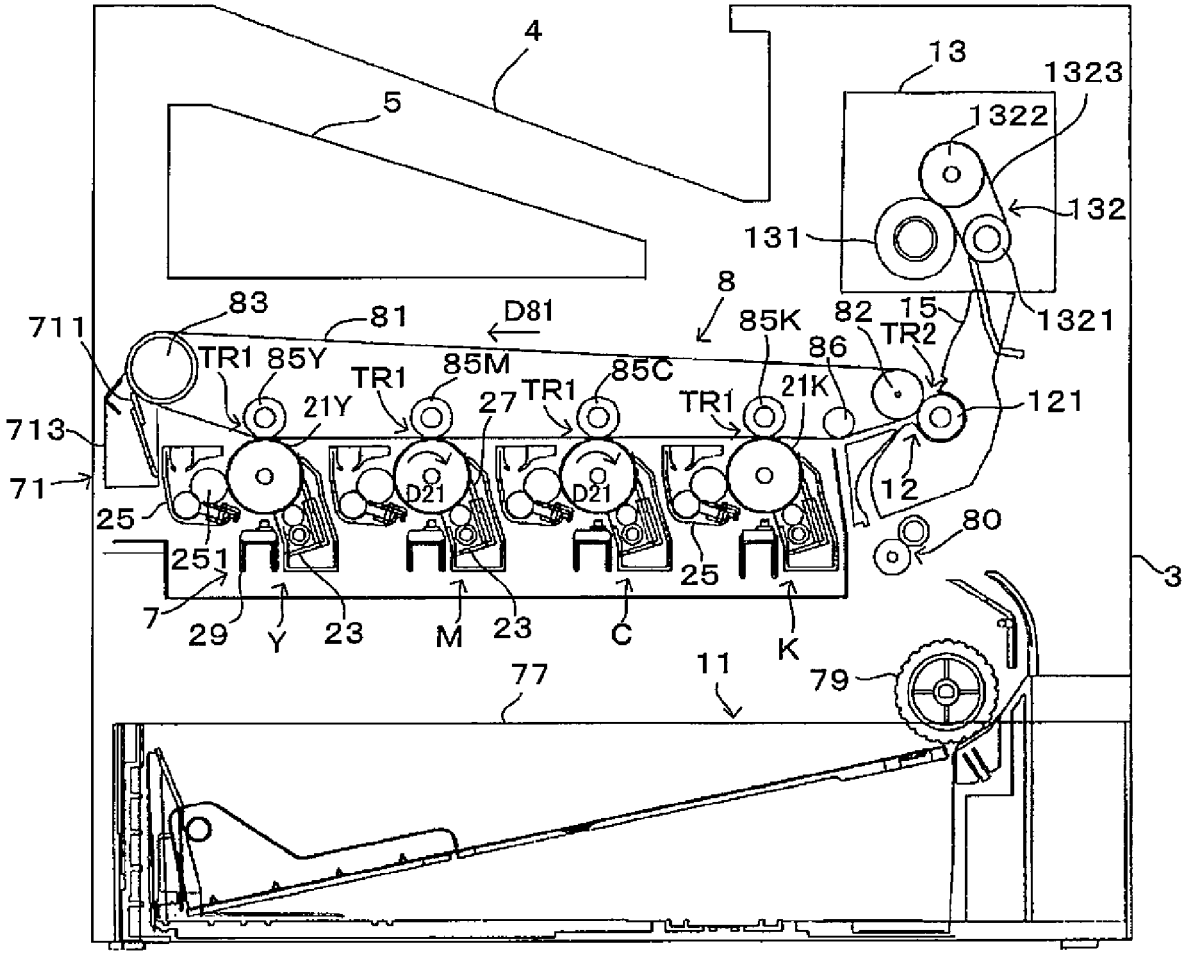
FIG. 3 is a diagram showing an embodiment of an image forming apparatus including a line head as an application subject of the invention.
Figure 4:
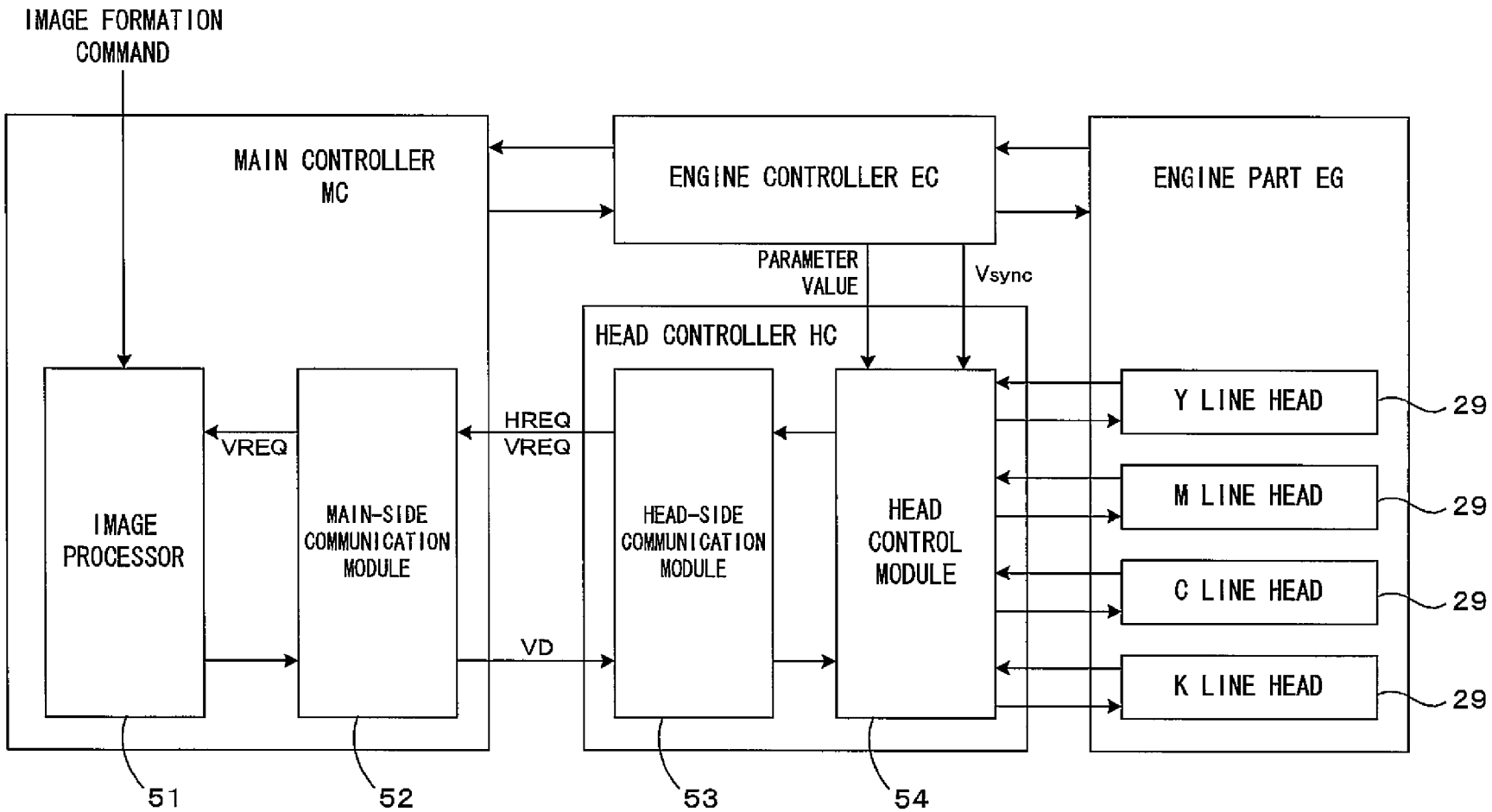
FIG. 4 is a diagram showing the electrical construction of the image forming apparatus of FIG. 3.

FIG. 3 is a diagram showing an embodiment of an image forming apparatus including a line head as an application subject of the invention. FIG. 4 is a diagram showing the electrical construction of the image forming apparatus of FIG. 3. This apparatus is an image forming apparatus that can selectively execute a color mode for forming a color image by superimposing four color toners of black (K), cyan (C), magenta (M) and yellow (Y) and a monochromatic mode for forming a monochromatic image using only black (K) toner. FIG. 3 is a diagram corresponding to the execution of the color mode. In this image forming apparatus, when an image formation command is given from an external apparatus such as a host computer to a main controller MC having a CPU and memories, the main controller MC feeds a control signal and the like to an engine controller EC and feeds video data VD corresponding to the image formation command to a head controller HC. This head controller HC controls line heads 29 of the respective colors based on the video data VD from the main controller MC, a vertical synchronization signal Vsync from the engine controller EC and parameter values from the engine controller EC. In this way, an engine part EG performs a specified image forming operation to form an image corresponding to the image formation command on a sheet such as a copy sheet, transfer sheet, form sheet or transparent sheet for OHP.

An electrical component box 5 having a power supply circuit board, the main controller MC, the engine controller EC and the head controller HC built therein is disposed in a housing main body 3 of the image forming apparatus. An image forming unit 7, a transfer belt unit 8 and a sheet feeding unit 11 are also arranged in the housing main body 3. A secondary transfer unit 12, a fixing unit 13 and a sheet guiding member 15 are arranged at the right side in the housing main body 3 in FIG. 3. It should be noted that the sheet feeding unit 11 is detachably mountable into the housing main body 3. The sheet feeding unit 11 and the transfer belt unit 8 are so constructed as to be detachable for repair or exchange respectively.

The image forming unit 7 includes four image forming stations Y (for yellow), M (for magenta), C (for cyan) and K (for black) which form a plurality of images having different colors. Each of the image forming stations Y, M, C and K includes a cylindrical photosensitive drum 21 having a surface of a specified length in a main scanning direction MD. Each of the image forming stations Y, M, C and K forms a toner image of the corresponding color on the surface of the photosensitive drum 21. The photosensitive drum is arranged so that the axial direction thereof is substantially parallel to the main scanning direction MD. Each photosensitive drum 21 is connected to its own driving motor and is driven to rotate at a specified speed in a direction of arrow D21 in FIG. 3, whereby the surface of the photosensitive drum 21 is transported in the sub scanning direction SD which is orthogonal to or substantially orthogonal to the main scanning direction MD. Further, a charger 23, the line head 29, a developer 25 and a photosensitive drum cleaner 27 are arranged in a rotating direction around each photosensitive drum 21. A charging operation, a latent image forming operation and a toner developing operation are performed by these functional sections. Accordingly, a color image is formed by superimposing toner images formed by all the image forming stations Y, M, C and K on a transfer belt 81 of the transfer belt unit 8 at the time of executing the color mode, and a monochromatic image is formed using only a toner image formed by the image forming station K at the time of executing the monochromatic mode. Meanwhile, since the respective image forming stations of the image forming unit 7 are identically constructed, reference characters are given to only some of the image forming stations while being not given to the other image forming stations in order to facilitate the diagrammatic representation in FIG. 3.

The charger 23 includes a charging roller having the surface thereof made of an elastic rubber. This charging roller is constructed to be rotated by being held in contact with the surface of the photosensitive drum 21 at a charging position. As the photosensitive drum 21 rotates, the charging roller is rotated at the same circumferential speed in a direction driven by the photosensitive drum 21. This charging roller is connected to a charging bias generator (not shown) and charges the surface of the photosensitive drum 21 at the charging position where the charger 23 and the photosensitive drum 21 are in contact upon receiving the supply of a charging bias from the charging bias generator.

The line head 29 is arranged relative to the photosensitive drum 21 so that the longitudinal direction thereof corresponds to the main scanning direction MD and the width direction thereof corresponds to the sub scanning direction SD. Hence, the longitudinal direction of the line head 29 is substantially parallel to the main scanning direction MD. The line head 29 includes a plurality of light emitting elements arrayed in the longitudinal direction and is positioned separated from the photosensitive drum 21. Light beams are emitted from these light emitting elements toward the surface of the photosensitive drum 21 charged by the charger 23, thereby forming an electrostatic latent image on this surface.

The developer 25 includes a developing roller 251 carrying toner on the surface thereof. By a development bias applied to the developing roller 251 from a development bias generator (not shown) electrically connected to the developing roller 251, charged toner is transferred from the developing roller 251 to the photosensitive drum 21 to develop the latent image formed by the line head 29 at a development position where the developing roller 251 and the photosensitive drum 21 are in contact.

The toner image developed at the development position in this way is primarily transferred to the transfer belt 81 at a primary transfer position TR1 to be described later where the transfer belt 81 and each photosensitive drum 21 are in contact after being transported in the rotating direction D21 of the photosensitive drum 21.

Further, the photosensitive drum cleaner 27 is disposed in contact with the surface of the photosensitive drum 21 downstream of the primary transfer position TR1 and upstream of the charger 23 with respect to the rotating direction D21 of the photosensitive drum 21. This photosensitive drum cleaner 27 removes the toner remaining on the surface of the photosensitive drum 21 to clean after the primary transfer by being held in contact with the surface of the photosensitive drum.

The transfer belt unit 8 includes a driving roller 82, a driven roller (blade facing roller) 83 arranged to the left of the driving roller 82 in FIG. 3, and the transfer belt 81 mounted on these rollers. The transfer belt unit 8 also includes four primary transfer rollers 85Y, 85M, 85C and 85K arranged to face in a one-to-one relationship with the photosensitive drums 21 of the respective image forming stations Y, M, C and K inside the transfer belt 81 when the photosensitive cartridges are mounted. These primary transfer rollers 85Y; 85M, 85C and 85K are respectively electrically connected to a primary transfer bias generator (not shown). As described in detail later, at the time of executing the color mode, all the primary transfer rollers 85Y, 85M, 85C and 85K are positioned on the sides of the image forming stations Y, M, C and K as shown in FIG. 3, whereby the transfer belt 81 is pressed into contact with the photosensitive drums 21 of the image forming stations Y, M, C and K to form the primary transfer positions TR1 between the respective photosensitive drums 21 and the transfer belt 81. By applying primary transfer biases from the primary transfer bias generator to the primary transfer rollers 85Y, 85M, 85C and 85K at suitable timings, the toner images formed on the surfaces of the respective photosensitive drums 21 are transferred to the surface of the transfer belt 81 at the corresponding primary transfer positions TR1 to form a color image.

On the other hand, out of the four primary transfer rollers 85Y, 85M, 85C and 85K, the color primary transfer rollers 85Y, 85M, 85C are separated from the facing image forming stations Y, M and C and only the monochromatic primary transfer roller 85K is brought into contact with the image forming station K at the time of executing the monochromatic mode, whereby only the monochromatic image forming station K is brought into contact with the transfer belt 81. As a result, the primary transfer position TR1 is formed only between the monochromatic primary transfer roller 85K and the image forming station K. By applying a primary transfer bias at a suitable timing from the primary transfer bias generator to the monochromatic primary transfer roller 85K, the toner image formed on the surface of the photosensitive drum 21 is transferred to the surface of the transfer belt 81 at the primary transfer position TR1 to form a monochromatic image.

The transfer belt unit 8 further includes a downstream guide roller 86 disposed downstream of the monochromatic primary transfer roller 85K and upstream of the driving roller 82. This downstream guide roller 86 is so disposed as to come into contact with the transfer belt 81 on an internal common tangent to the primary transfer roller 85K and the photosensitive drum 21 at the primary transfer position TR1 formed by the contact of the monochromatic primary transfer roller 85K with the photosensitive drum 21 of the image forming station K.

The driving roller 82 drives to rotate the transfer belt 81 in the direction of the arrow D81 and doubles as a backup roller for a secondary transfer roller 121. A rubber layer having a thickness of about 3 mm and a volume resistivity of 1000 kΩ·cm or lower is formed on the circumferential surface of the driving roller 82 and is grounded via a metal shaft, thereby serving as an electrical conductive path for a secondary transfer bias to be supplied from an unillustrated secondary transfer bias generator via the secondary transfer roller 121. By providing the driving roller 82 with the rubber layer having high friction and shock absorption, an impact caused upon the entrance of a sheet into a contact part (secondary transfer position TR2) of the driving roller 82 and the secondary transfer roller 121 is unlikely to be transmitted to the transfer belt 81 and image deterioration can be prevented.

The sheet feeding unit 11 includes a sheet feeding section which has a sheet cassette 77 capable of holding a stack of sheets, and a pickup roller 79 which feeds the sheets one by one from the sheet cassette 77. The sheet fed from the sheet feeding section by the pickup roller 79 is fed to the secondary transfer position TR2 along the sheet guiding member 15 after having a sheet feed timing adjusted by a pair of registration rollers 80.

The secondary transfer roller 121 is provided freely to abut on and move away from the transfer belt 81, and is driven to abut on and move away from the transfer belt 81 by a secondary transfer roller driving mechanism (not shown). The fixing unit 13 includes a heating roller 131 which is freely rotatable and has a heating element such as a halogen heater built therein, and a pressing section 132 which presses this heating roller 131. The sheet having an image secondarily transferred to the front side thereof is guided by the sheet guiding member 15 to a nip portion formed between the heating roller 131 and a pressure belt 1323 of the pressing section 132, and the image is thermally fixed at a specified temperature in this nip portion. The pressing section 132 includes two rollers 1321 and 1322 and the pressure belt 1323 mounted on these rollers. Out of the surface of the pressure belt 1323, a part stretched by the two rollers 1321 and 1322 is pressed against the circumferential surface of the heating roller 131, thereby forming a sufficiently wide nip portion between the heating roller 131 and the pressure belt 1323. The sheet having been subjected to the image fixing operation in this way is transported to the discharge tray 4 provided on the upper surface of the housing main body 3.

Further, a cleaner 71 is disposed facing the blade facing roller 83 in this apparatus. The cleaner 71 includes a cleaner blade 711 and a waste toner box 713. The cleaner blade 711 removes foreign matters such as toner remaining on the transfer belt after the secondary transfer and paper powder by holding the leading end thereof in contact with the blade facing roller 83 via the transfer belt 81. Foreign matters thus removed are collected into the waste toner box 713. Further, the cleaner blade 711 and the waste toner box 713 are constructed integral to the blade facing roller 83. Accordingly, when the blade facing roller 83 moves, the cleaner blade 711 and the waste toner box 713 move together with the blade facing roller 83.

Figure 5:
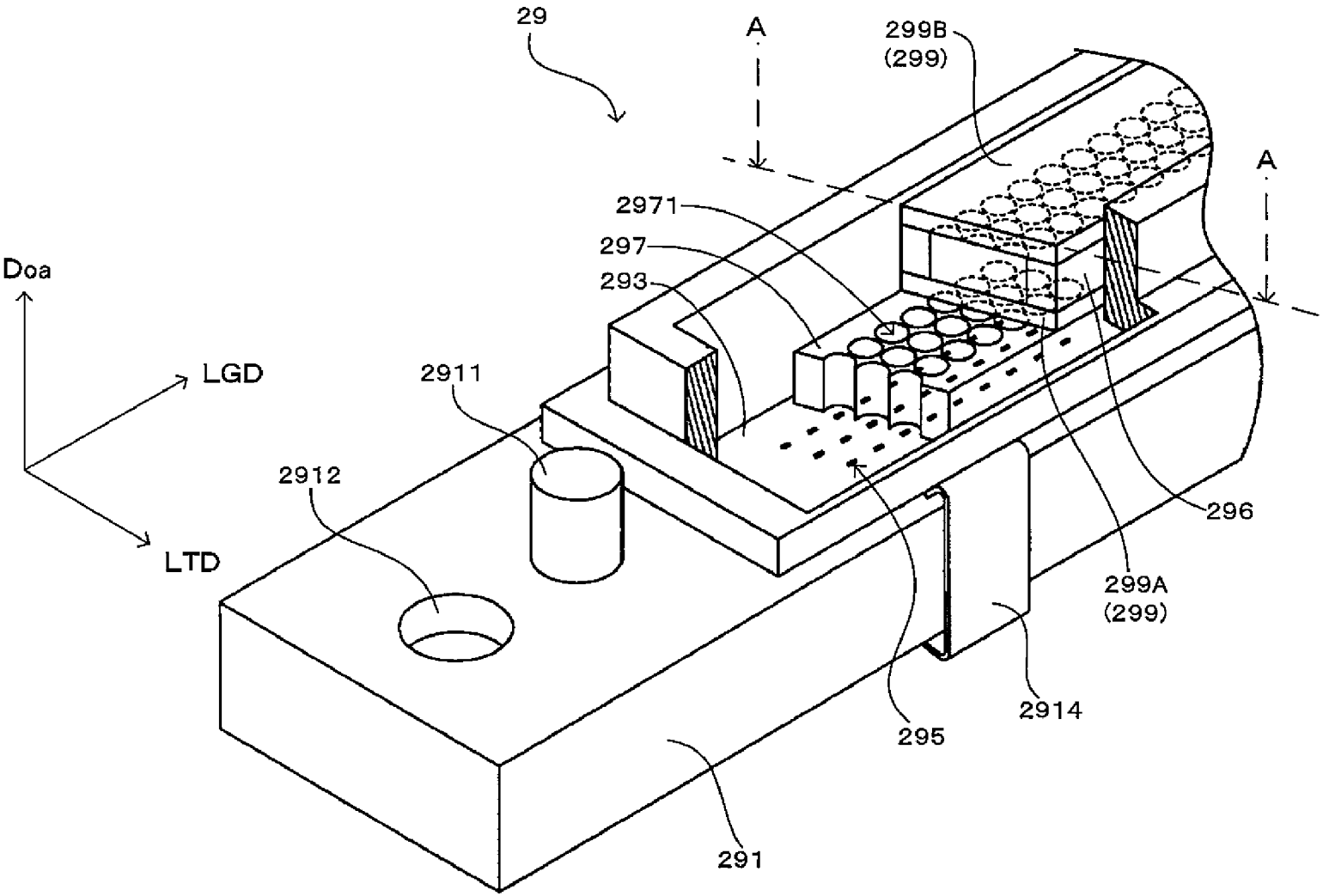
FIG. 5 is a perspective view schematically showing a line head according to the invention.
Figure 6:
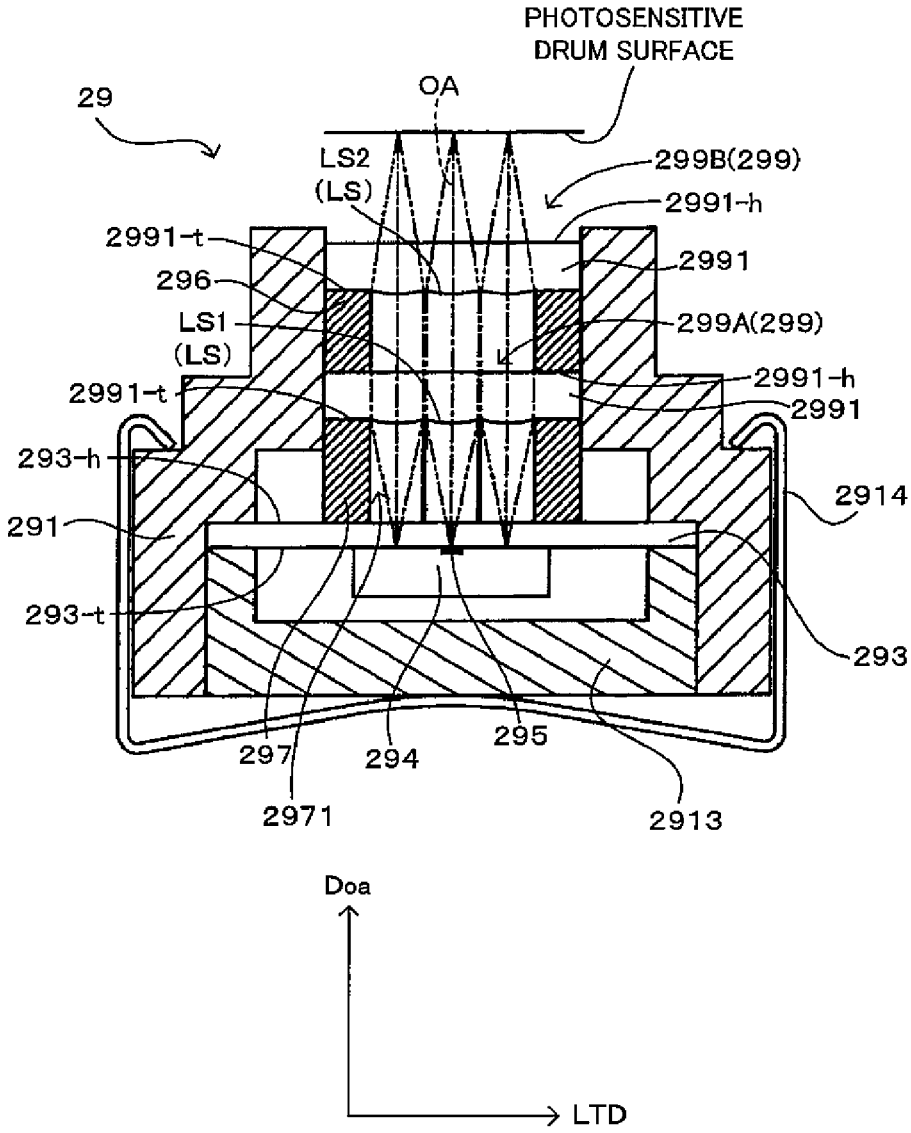
FIG. 6 is a partial sectional view along a width direction of the line head shown in FIG. 5 in which the cross section is parallel to the optical axis of the lens.

FIG. 5 is a perspective view schematically showing a line head according to the invention, and FIG. 6 is a partial sectional view along a width direction of the line head shown in FIG. 5 in which the cross section is parallel to the optical axis of the lens. As described above, the line head 29 is arranged relative to the photosensitive drum 21 such that the longitudinal direction LGD thereof corresponds to the main scanning direction MD and the width direction LTD thereof corresponds to the sub scanning direction SD. The longitudinal direction LGD and the width direction LTD are orthogonal to or substantially orthogonal to each other. As described later, in this line head 29, a plurality of light emitting elements are formed on the head substrate 293 and the respective light emitting elements emit light beams toward the surface of the photosensitive drum 21. Accordingly, in this specification, a direction orthogonal to the longitudinal direction LGD and to the width direction LTD and propagating from the light emitting elements toward the photosensitive drum surface is referred to as a light beam propagation direction Doa. This light beam propagation direction Doa is parallel to or substantially parallel to optical axes OA to be described later.

The line head 29 includes a case 291, and a positioning pin 2911 and a screw insertion hole 2912 are provided at each of the opposite ends of such a case 291 in the longitudinal direction LGD. The line head 29 is positioned relative to the photosensitive drum 21 by fitting such positioning pins 2911 into positioning holes (not shown) perforated in a photosensitive drum cover (not shown) covering the photosensitive drum 21 and positioned relative to the photosensitive drum 21. Further, the line head 29 is positioned and fixed relative to the photosensitive drum 21 by screwing fixing screws into screw holes (not shown) of the photosensitive drum cover via the screw insertion holes 2912 to be fixed.

The head substrate 293, a light shielding member 297 and two lens arrays 299 (299A, 299B) are arranged in the case 291. The inner side of the case 291 is held in contact with a top surface 293-*h* of the head substrate 293, whereas an under lid 2913 is held in contact with an under surface 293-*t* of the head substrate 293. This under lid 2913 is pressed against the inner side of the case 291 via the head substrate 293 by fixing devices 2914. In other words, the fixing devices 2914 have elastic forces for pressing the under lid 2913 toward the inner side (upper side in FIG. 6) of the case 291 and the interior of the case 291 is light-tightly sealed (in other words, so that light does not leak from the interior of the case 291 and light does not enter the case 291 from the outside) by the under lid being pressed by such elastic forces. The fixing devices 2914 are provided at a plurality of positions spaced apart in the longitudinal direction LGD of the case 291.

The light emitting element groups 295 formed by grouping a plurality of light emitting elements are provided on the under surface 293-*t* of the head substrate 293. The head substrate 293 is made of a light transmissive material such as glass, and light beams emitted from the respective light emitting elements of the light emitting element groups 295 can transmit from the under surface 293-*t* of the head substrate 293 to the top surface 293-*h* thereof. These light emitting elements are bottom emission-type organic EL (electro-luminescence) devices and are covered by a sealing member 294. The detailed arrangement of the light emitting elements on the under surface 293-*t* of the head substrate 293 is as follows.

Figure 7:
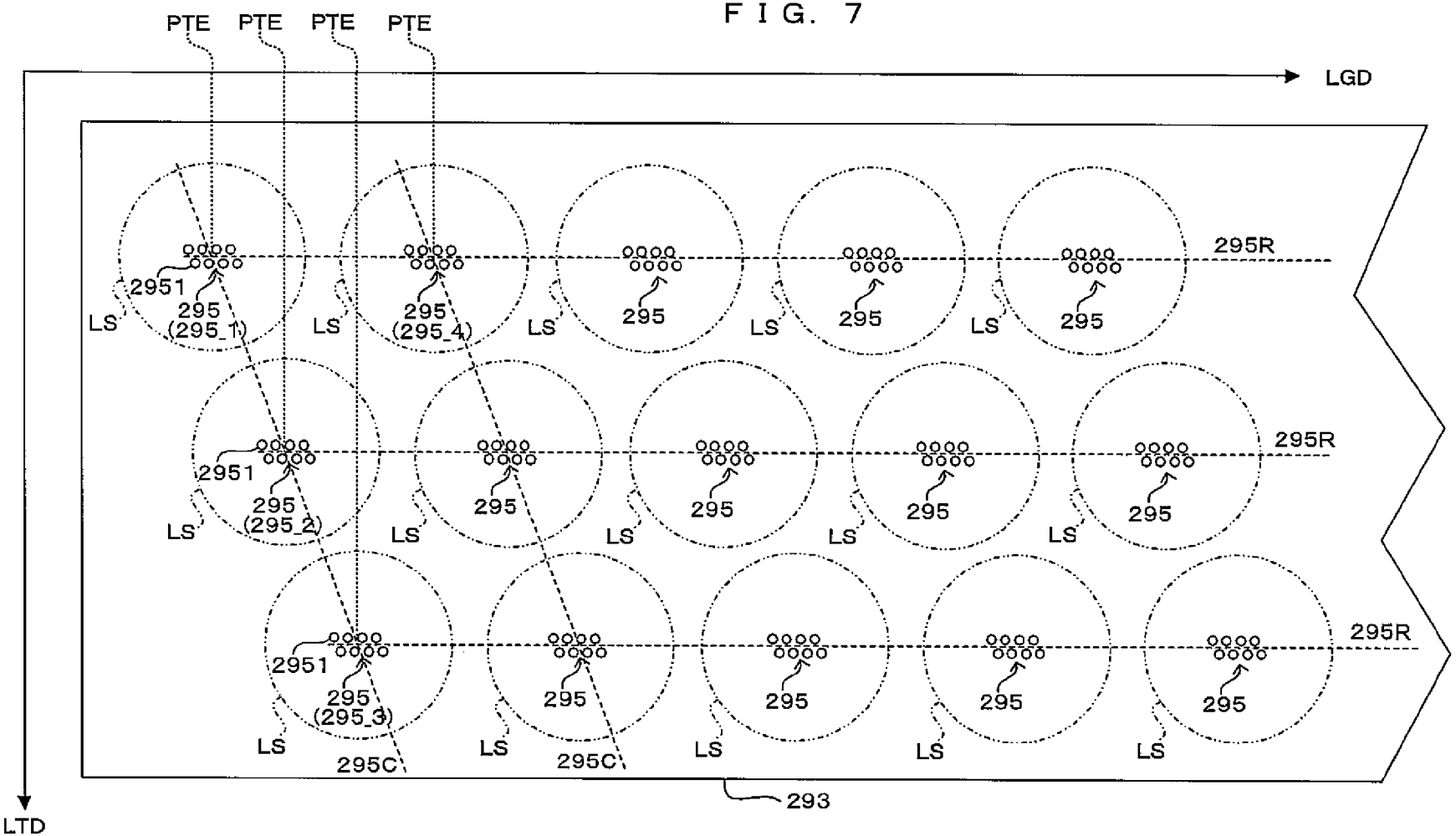
FIG. 7 is a diagram showing the configuration of the under surface of the head substrate.
Figure 8:
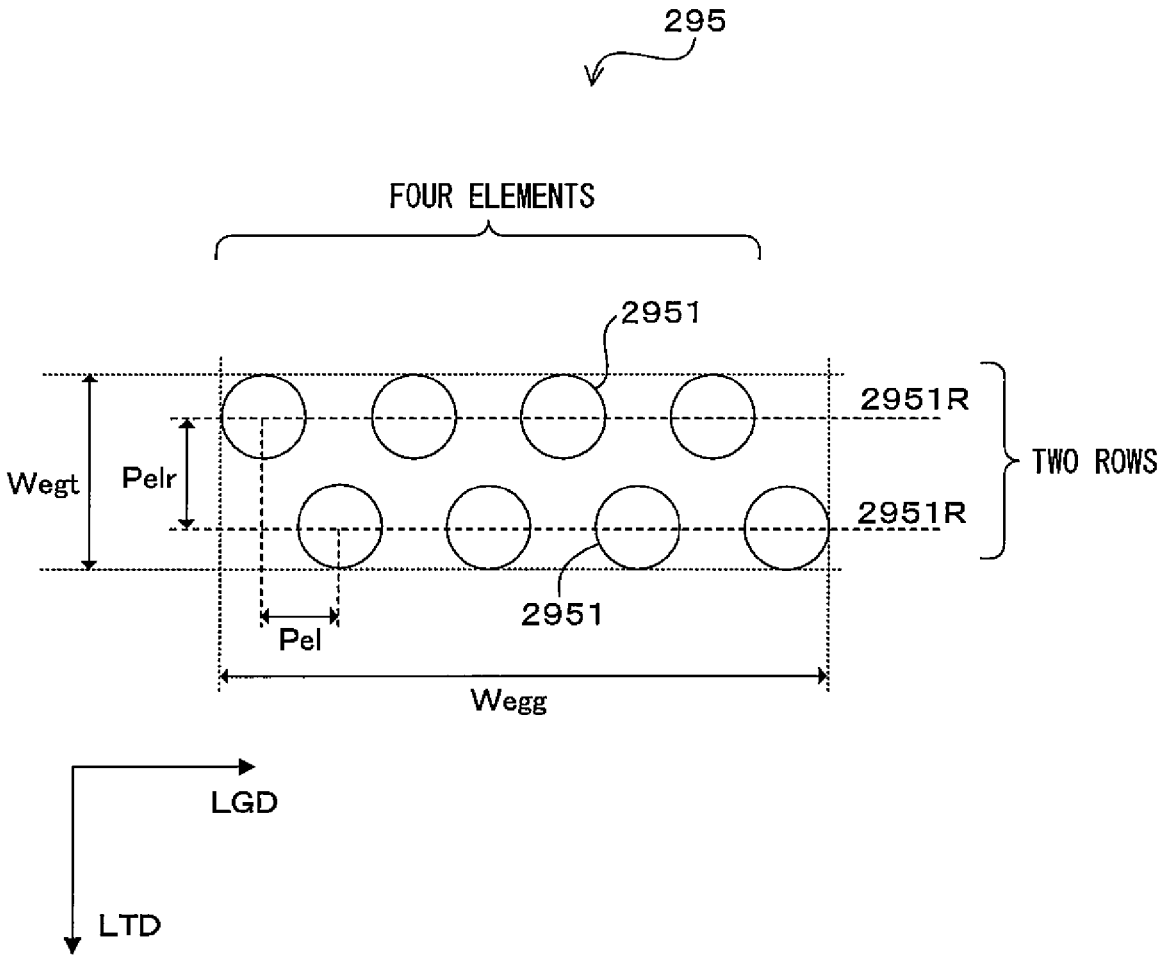
FIG. 8 is a diagram showing the configuration of the light emitting element group provided on the under surface of the head substrate.

FIG. 7 is a diagram showing the configuration of the under surface of the head substrate and corresponds to a case where the under surface is seen from the top surface of the head substrate. FIG. 8 is a diagram showing the configuration of the light emitting element group provided on the under surface of the head substrate. As shown in FIG. 7, the light emitting element group 295 is formed by grouping eight light emitting elements 2951. In each light emitting element group 295, eight light emitting elements 2951 are arranged as follows. Specifically, as shown in FIG. 8, in the light emitting element group 295, four light emitting elements 2951 are aligned in the longitudinal direction LGD to form a light emitting element row 2951R and two light emitting element rows 2951R are arranged at a light emitting element row pitch Pelr in the width direction LTD. The respective light emitting element rows 2951R are displaced from each other in the longitudinal direction LGD by a light emitting element pitch Pel, so that the positions of the respective light emitting elements 2951 in the longitudinal direction LGD differ from each other The light emitting element group 295 thus configured has a longitudinal width Wegg in the longitudinal direction LGD and a widthwise width Wegt in the width direction LTD, wherein the longitudinal width Wegg is larger than the widthwise width Wegt.

A plurality of light emitting element groups 295 thus configured are arranged on the under surface 293-*t* of the head substrate 293. Specifically, three light emitting element groups 295 are arranged at positions mutually different in the width direction LTD to form a light emitting element group column 295C, and a plurality of light emitting element group columns 295C are arranged in the longitudinal direction LGD. In each light emitting element group column 295C, three light emitting element groups 295 are displaced from each other by the light emitting element group pitch Peg in the longitudinal direction LGD, with the result that positions PTE of the respective light emitting element groups 295 in the longitudinal direction LGD differ from each other. In other words, on the under surface 293-*t* of the head substrate 293, a plurality of light emitting element groups 295 are aligned in the longitudinal direction LGD to form a light emitting element group row 295R, and three light emitting element group rows 295R are arranged at the light emitting element group row pitches Pegr in the width direction LTD. Further, the respective light emitting element group rows 295R are displaced from each other by the light emitting element group pitch Peg in the longitudinal direction LGD, with the result that the positions PTE of the respective light emitting element groups 295 in the longitudinal direction LGD differ from each other. Thus, in this embodiment, a plurality of light emitting element groups 295 are two-dimensionally arranged on the head substrate 293. In FIG. 7, the positions of the light emitting element groups 295 are represented by the center of gravity positions of the light emitting element groups 295, and the positions PTE of the light emitting element groups 295 in the longitudinal direction LGD are indicated by feet of perpendiculars to an axis of the longitudinal direction LGD from the positions of the light emitting element groups 295.

The respective light emitting elements 2951 formed on the head substrate 293 in this way emit light beams having an equal wavelength upon being driven, for example, by a TFT (thin film transistor) circuit or the like. The light emitting surfaces of the light emitting elements 2951 are so-called perfectly diffusing surface illuminants and the light beams emitted from the light emitting surfaces comply with Lambert's cosine law.

Referring back to FIGS. 5 and 6, description continues. The light shielding member 297 is arranged in contact with the top surface 293-*h* of the head substrate 293. The light shielding member 297 is provided with light guide holes 2971 for the respective plurality of light emitting element groups 295. In other words, a plurality of light guide holes 2971 are formed in a one-to-one correspondence with the plurality of light emitting element groups 295. The light guide holes 2971 are formed as holes penetrating the light shielding member 297 in the light beam propagation direction Doa. Further, two lens arrays 299 are arranged side by side in the light beam propagation direction Doa above the light shielding member 297 (at a side opposite to the head substrate 293).

As described above, the light shielding member 297 provided with the light guide holes 2971 for the respective light emitting element groups 295 is arranged between the light emitting element groups 295 and the lens arrays 299 in the light beam propagation direction Doa. Accordingly, light beams emitted from the light emitting element groups 295 propagate toward the lens arrays 299 through the light guide holes 2971 corresponding to the light emitting element groups 295. Conversely speaking, out of the light beams emitted from the light emitting element groups 295, those propagating toward other than the light guide holes 2971 corresponding to the light emitting element groups 295 are shielded by the light shielding member 297. In this way, all the lights emitted from one light emitting element group 295 propagate toward the lens arrays 299 via the same light guide hole 2971 and the mutual interference of the light beams emitted from different light emitting element groups 295 is prevented by the light shielding member 297.

Figure 9:
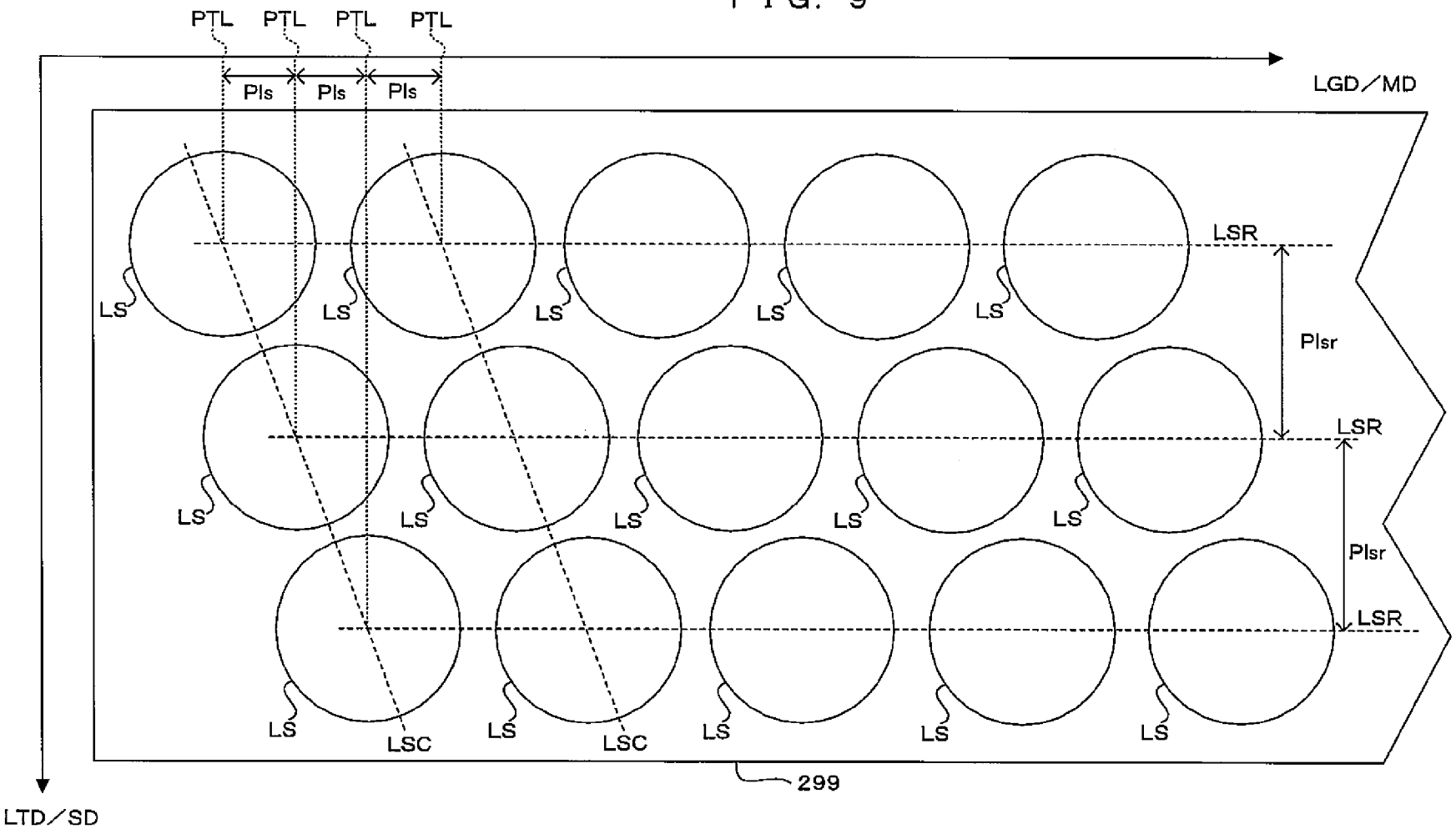
FIG. 9 is a plan view of the lens array according to this embodiment.

FIG. 9 is a plan view of the lens array according to this embodiment and corresponds to a case where the lens array is seen from an image plane side (in the light beam propagation direction Doa). The respective lenses LS in FIG. 9 are formed on an under surface 2991-*t* of a lens array substrate 2991 and the construction of this lens array substrate under surface 2991-*t* is shown in FIG. 9. Although the light emitting element groups 295 are shown in FIG. 9, this is to show a correspondence relationship of the light emitting element groups 295 and the lenses LS and the light emitting element groups 295 are not formed on the lens array substrate under surface 2991-*t*. As shown in FIG. 9, one lens LS is provided for each light emitting element group 295 in the lens array 299. Specifically, in the lens array 299, three lenses LS are arranged at different positions in the width direction LTD to form a lens column LSC, and a plurality of lens columns LSC are arranged in the longitudinal direction LGD. In each lens column LSC, three lenses LS are displaced from each other by the lens pitch Pls, with the result that positions PTL of the respective lenses LS in the longitudinal direction LGD differ from each other.

In other words, in the lens array 299, a plurality of lenses LS are aligned in the longitudinal direction LGD to form a lens row LSR, and three lens rows LSR are arranged at the lens row pitch Plsr in the width direction LTD. The respective plurality of lens rows LSR thus arranged are opposed facing positions on the photosensitive drum surface different from each other in the sub scanning direction SD. Further, the respective lens rows LSR are displaced from each other by the lens pitch Pls in the longitudinal direction LGD, and the positions PTL of the respective lenses LS in the longitudinal direction LGD differ from each other.

In this way, the plurality of lenses LS are two-dimensionally arranged in the lens array 299. In FIG. 9, the positions of the lenses LS are represented by the tops of the lenses LS (that is, points where sag is maximum) and the positions PTL of the lenses LS in the longitudinal direction LGD are represented by feet of perpendiculars to the axis in the longitudinal direction LGD from the tops of the lenses LS.

Figure 10:
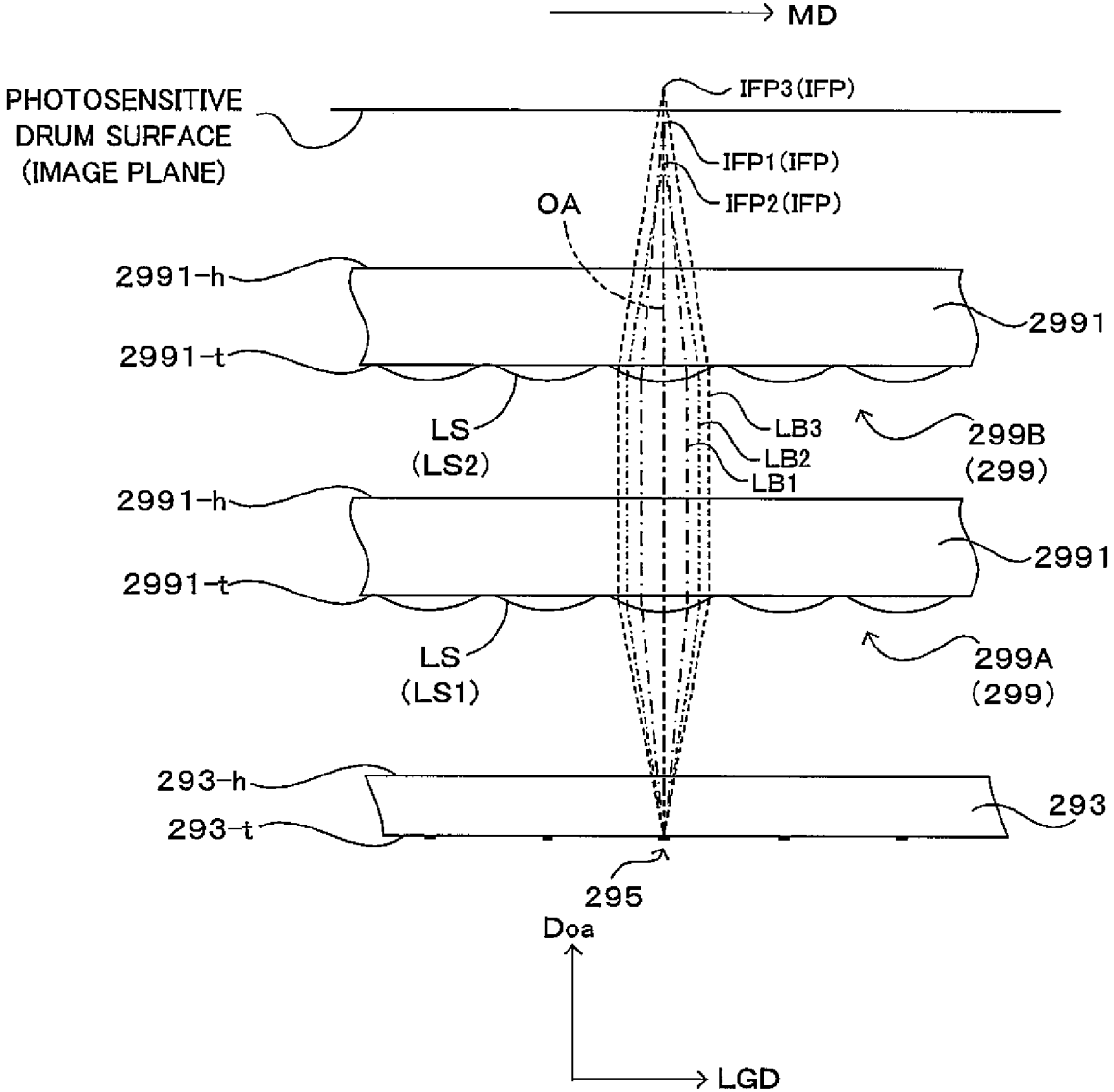
FIG. 10 is a longitudinal sectional view of the lens arrays, the head substrate and the like showing a longitudinal cross section including an optical axis of the lens formed in the lens array.

FIG. 10 is a longitudinal sectional view of the lens arrays, the head substrate and the like showing a longitudinal cross section including an optical axis of the lens LS formed in the lens array. The lens array 299 includes the light transmissive lens array substrate 2991 long in the longitudinal direction LGD. In this embodiment, this lens array substrate 2991 is made of a glass having a relatively small linear expansion coefficient. Out of a top surface 2991-*h* and the under surface 2991-*t* of the lens array substrate 2991, the lenses LS are formed on the under surface 2991-*t* of the lens array substrate 2991. This lens array 299 is formed by a method disclosed in JP-A-2005-276849 for example. Specifically, a mold formed with recesses in conformity with the shape of the lenses LS is held in contact with a glass substrate as a lens substrate 2991. A clearance between the mold and the light transmissive substrate is filled with a light curing resin. When light is irradiated to this light curing resin, the light curing resin is cured and the lenses LS are formed on the light transmissive substrate. After the lenses are formed by solidifying the light curing resin, the mold is released. The respective lenses LS formed in the lens array 299 have identical structures.

As described above, in this embodiment, the lens array 299 is made up of the lens array substrate 2991 and the lenses LS. Accordingly, a degree of freedom in the construction of the lens array 299 is improved, for example, by enabling the selection of different base materials for the lens array substrate 2991 and the lenses LS. Thus, the lens array 299 can be appropriately designed depending on specification required for the line head 29 and a good exposure by the line head 29 can be easily realized. Further, in this embodiment, the lenses LS are made of the light curing resin that can be quickly cured upon light irradiation. Accordingly, the lenses LS can be easily formed, wherefore the cost of the lens array 299 can be reduced by simplifying the production process of the lens array 299. Furthermore, since the lens array substrate 2991 is made of glass having a small linear expansion coefficient, a good exposure can be realized independently of temperature by suppressing the deformation of the lens array 299 caused by a temperature change.

In this line head 29, two lens arrays 299 (299A, 299B) having such a configuration are arranged side by side in the light beam propagation direction Doa. These two lens arrays 299A, 299B are opposed to each other with a pedestal 296 located therebetween, and this pedestal 296 fulfills a function of specifying the spacing between the lens arrays 299A, 299B. Thus, in this embodiment, two lenses LS1, LS2 aligned in the light beam propagation direction Doa are arranged for each light emitting element group 295 (FIGS. 5, 6 and 10). An optical axis OA (chain double-dashed line in FIG. 10) passing the centers of the first and second lenses LS1, LS2 corresponding to the same light emitting element group 295 is orthogonal to or substantially orthogonal to the under surface 293-*t* of the head substrate 293. Here, the lens LS of the lens array 299A upstream in the light beam propagation direction Doa is the first lens LS1, and that of the lens array 299B downstream in the light beam propagation direction Doa is the second lens LS2. In this embodiment, since a plurality of lens arrays 299 are arranged side by side in the light beam propagation direction Doa, a degree of freedom in optical design can be increased. Thus, in this embodiment, the first lens LS1 is an object side lens or a light emitting element side lens and the second lens LS2 is an image side lens.

As described above, the line head 29 is provided with an imaging optical system which includes the first and the second lenses LS1, LS2. The surface (image plane) of the photosensitive drum 21 faces the imaging optical system in the light beam propagation direction Doa (in other words, in the direction in which the imaging optical system faces the image plane) and the respective lenses LS emit light beams toward the photosensitive drum surface. Accordingly, the light beams emitted from the light emitting element groups 295 are imaged by the first lens LS1 and the second lens LS2 to form spots SP on the photosensitive drum surface (image plane). In this embodiment, the second lenses LS2 are single focal lenses having a single focal point, whereas the first lenses LS1 are lenses each having three focal points with mutually different focal lengths. In other words, a lens surface LSF of each first lens LS1 has a plurality of areas LR and the positions of focal points FP of the plurality of areas LR differ from each other in the light beam propagation direction Doa (third direction).

Figure 11:
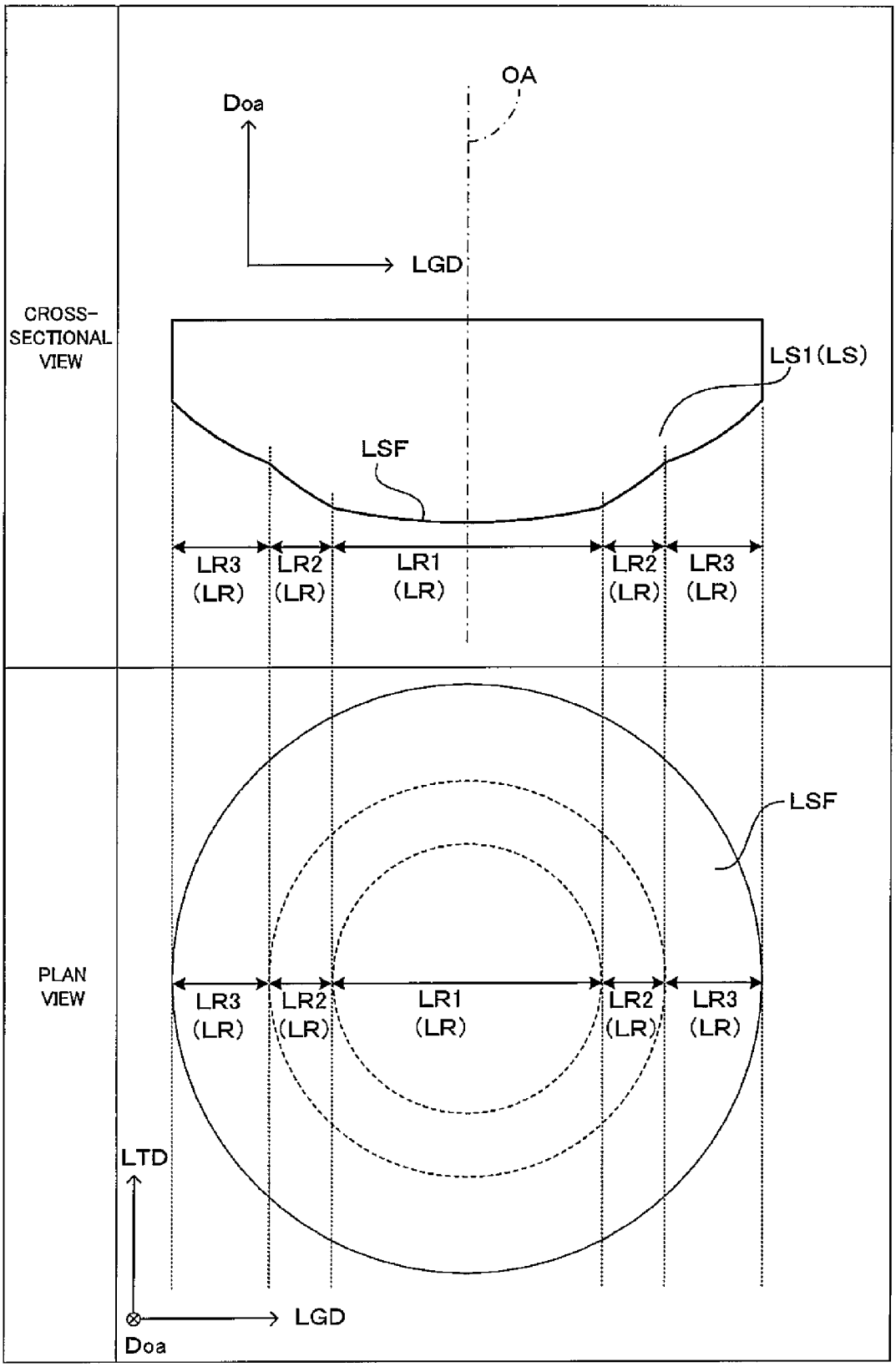
FIG. 11 is a diagram showing the construction of the first lens.

FIG. 11 is a diagram showing the construction of the first lens, wherein the section "Cross-Sectional View" in an upper part of FIG. 11 corresponds to a cross-sectional view of the first lens LS1 including the optical axis OA and the section "Plan View" in an lower part of FIG. 11 corresponds to a plan view when the first lens LS1 is seen from an upstream side in the light beam propagation direction Doa. The lens surface LSF of this first lens LS1 is a free-form surface and has a plurality of focal points FP in the light beam propagation direction Doa. Specifically, this is as follows. As shown in FIG. 11, the first lens LS1 has a shape rotationally symmetrical with respect to the optical axis OA. Further, the lens surface LSF of the first lens LS1 is divided into three areas LR. Specifically, a first area LR1 located in the center, a second area LR2 located outside the first area LR1 and a third area LR3 located outside the first and the second areas LR1, LR2 are defined in the lens surface LSF. The first area LR1 is a circular area centered on the optical axis OA. The second area LR2 is an annular area (ring-shaped area) surrounding the first area LR1 and concentric with the first area LS1. The third area LR3 is an annular area (ring-shaped area) surrounding the first and second areas LR1, LS2 and concentric with the first area LS1 (and the second area LR2). As shown in the section "Cross-Sectional View" of FIG. 11, the first, the second and the third areas LS1, LS2 and LS3 have decreasing lens thicknesses in this order. In other words, the first area LR1 has the largest lens thickness and the third area LR3 has the smallest lens thickness. The respective areas LR1 to LR3 have mutually different focal points FP.

Figure 12:
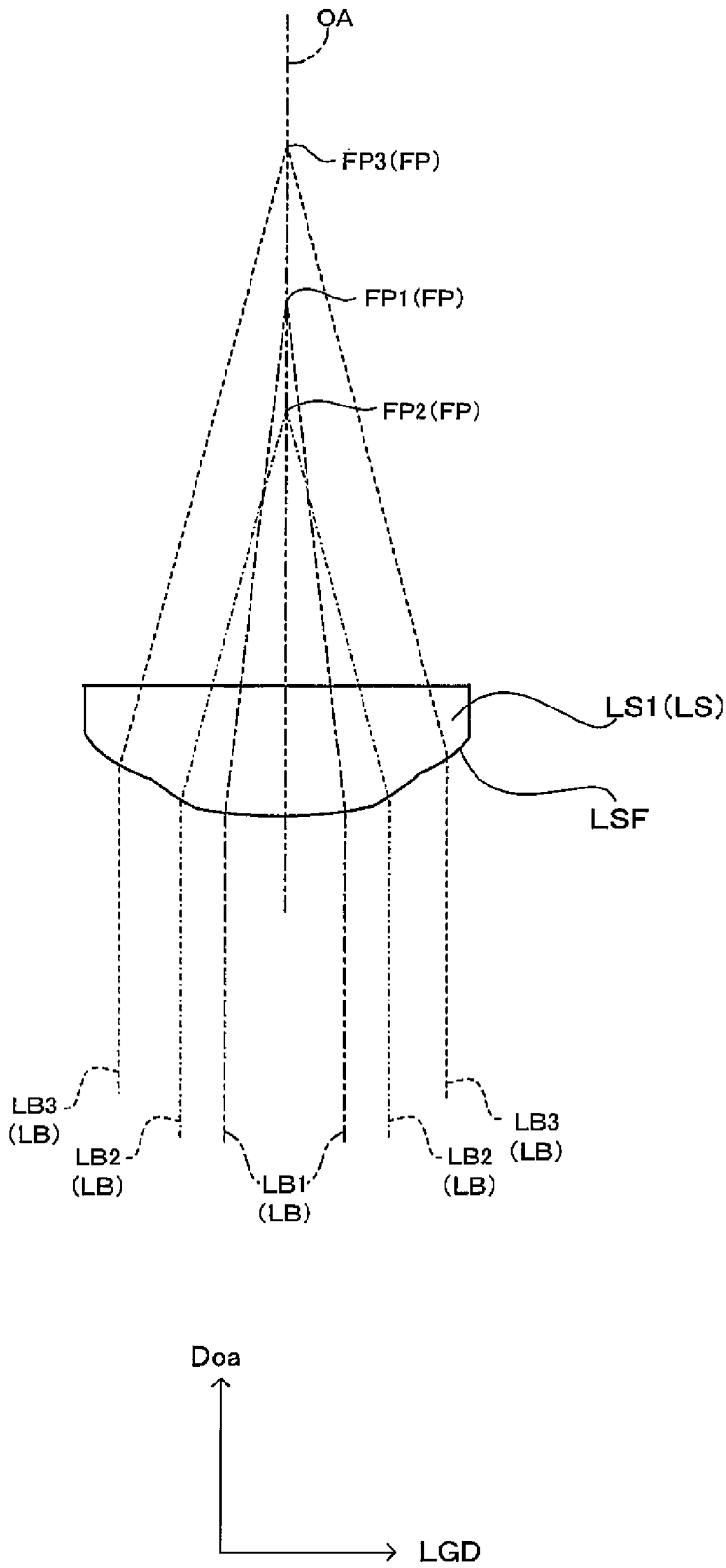
FIG. 12 is a diagram showing the positions of the focal points of the first lens.

FIG. 12 is a diagram showing the positions of the focal points of the first lens in the case where parallel light (that is, light from an infinitely distant object point) is incident on the first lens LS1. As shown in FIG. 12, light beams LB before being incident on the first lens LS1 are parallel to each other. However, paths of the light beams LB after being incident on the first lens LS1 differ depending on the areas of the lens surface LSF on which the light beams LB were incident. In other words, the first light beams LB1 incident on the first area LR1 are imaged at the focal point FP1 of the first area LR1, the second light beams LB2 incident on the second area LR2 are imaged at the focal point FP2 of the second area LR2 and the third light beams LB3 incident on the third area LR3 are imaged at the focal point FP3 of the third area LR3. The positions of the respective focal points FP1 to FP3 differ from each other in the light beam propagation direction Doa and are arranged linearly or substantially linearly in the light beam propagation direction Doa in the order of FP2, FP1 and FP3.

In other words, the first lens LS1 functions as a multifocal lens having a plurality of focal points FP1 to FP3 with mutually different focal lengths. As a result, the imaging optical system including the multifocal lens LS1 has a plurality of imaging positions IFP. If this is described with reference to FIG. 10, the first light beams LB1 incident on the first area LR1 are imaged at an imaging position IFP1, the second light beams LB2 incident on the second area LR2 are imaged at an imaging position IFP2 and the third light beams LB3 incident on the third area LR3 are imaged at an imaging position IFP3. The respective imaging positions IFP1 to IFP3 differ from each other in the light beam propagation direction Doa and are arranged linearly or substantially linearly in the light beam propagation direction Doa in the order of IFP2, IFP1 and IFP3. In this way, spots SP are formed on the photosensitive drum surface by the imaged light beams.

As described above, the photosensitive drum surface is charged by the charger 23 prior to spot formation as described above. Thus, areas where the spots SP are formed are neutralized to form spot latent images Lsp. The spot latent images Lsp thus formed are conveyed toward a downstream side in the sub scanning direction SD while being carried on the photosensitive drum surface. As described next, the spots SP are formed at timings in conformity with the movement of the photosensitive drum surface to form a plurality of spot latent images Lsp aligned in the main scanning direction MD.

Figure 13:
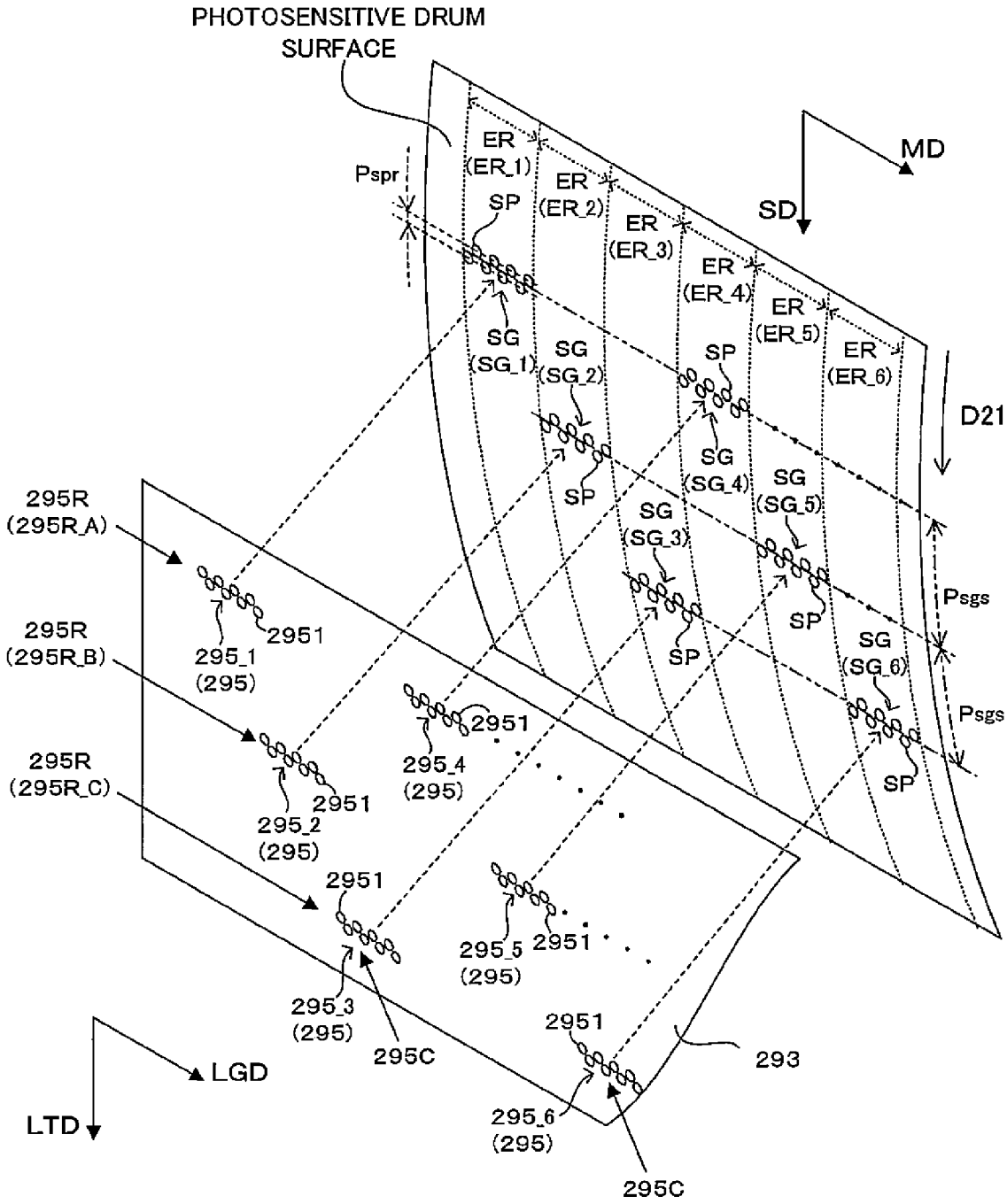
FIG. 13 is a perspective view showing spots formed by the line head.

FIG. 13 is a perspective view showing spots formed by the line head. The lens array 299 is not shown in FIG. 13. As shown in FIG. 13, the respective light emitting element groups 295 can form the spot groups SG in exposure regions ER mutually different in the main scanning direction MD. Here, the spot group SG is a set of a plurality of spots SP formed by the simultaneous light emissions of all the light emitting elements 2951 of the light emitting element group 295. As shown in FIG. 13, three light emitting element groups 295 capable of forming the spot groups SG in the exposure regions ER consecutive in the main scanning direction MD are displaced from each other in the width direction LTD. In other words, three light emitting element groups 295_1, 295_2 and 295_3 capable of forming spot groups SG_1, SG_2 and SG_3, for example, in exposure regions ER_1, ER_2 and ER_3 consecutive in the main scanning direction MD are displaced from each other in the width direction LTD. These three light emitting element groups 295 constitute the light emitting element group column 295C, and a plurality of light emitting element group columns 295C are arranged in the longitudinal direction LGD. As a result, three light emitting element group rows 295R_A, 295R_B and 295R_C are arranged in the width direction LTD and the respective light emitting element group rows 295R_A etc. form the spot groups SG at positions mutually different in the sub scanning direction SD as already described in the description of FIG. 7.

Specifically, in this line head 29, the plurality of light emitting element groups 295 (for example, light emitting element groups 295_1, 295_2, 295_3) are arranged at positions mutually different in the width direction LTD. The respective light emitting element groups 295 arranged at the positions mutually different in the width direction LTD form spot groups SG (for example, spot groups SG_1, SG_2, SG_3) at positions mutually different in the sub scanning direction SD.

In other words, in this line head 29, the plurality of light emitting elements 2951 are arranged at positions mutually different in the width direction LTD. For example, the light emitting elements 2951 belonging to the light emitting element group 295_1 and those belonging to the light emitting element group 295_2 are arranged at positions mutually different in the width direction LTD. The respective light emitting elements 2951 arranged at the positions mutually different in the width direction LTD form spots SP at positions mutually different in the sub scanning direction SD. For example, spots SP belonging to the spot group SG_1 and those belonging to the spot group SG_2 are formed at positions mutually different in the sub scanning direction SD.

In this way, the formation positions of the spots SP in the sub scanning direction SD differ depending on the light emitting elements 2951. Accordingly, in order to form a plurality of spot latent images Lsp side by side in the main scanning direction MD (that is, in order to form a plurality of spot latent images Lsp side by side at the same position in the sub scanning direction SD), differences in such spot formation positions need to be considered. Thus, in this line head 29, the respective light emitting elements 2951 are driven at timings in conformity with the movement of the photosensitive drum surface.

Figure 14:
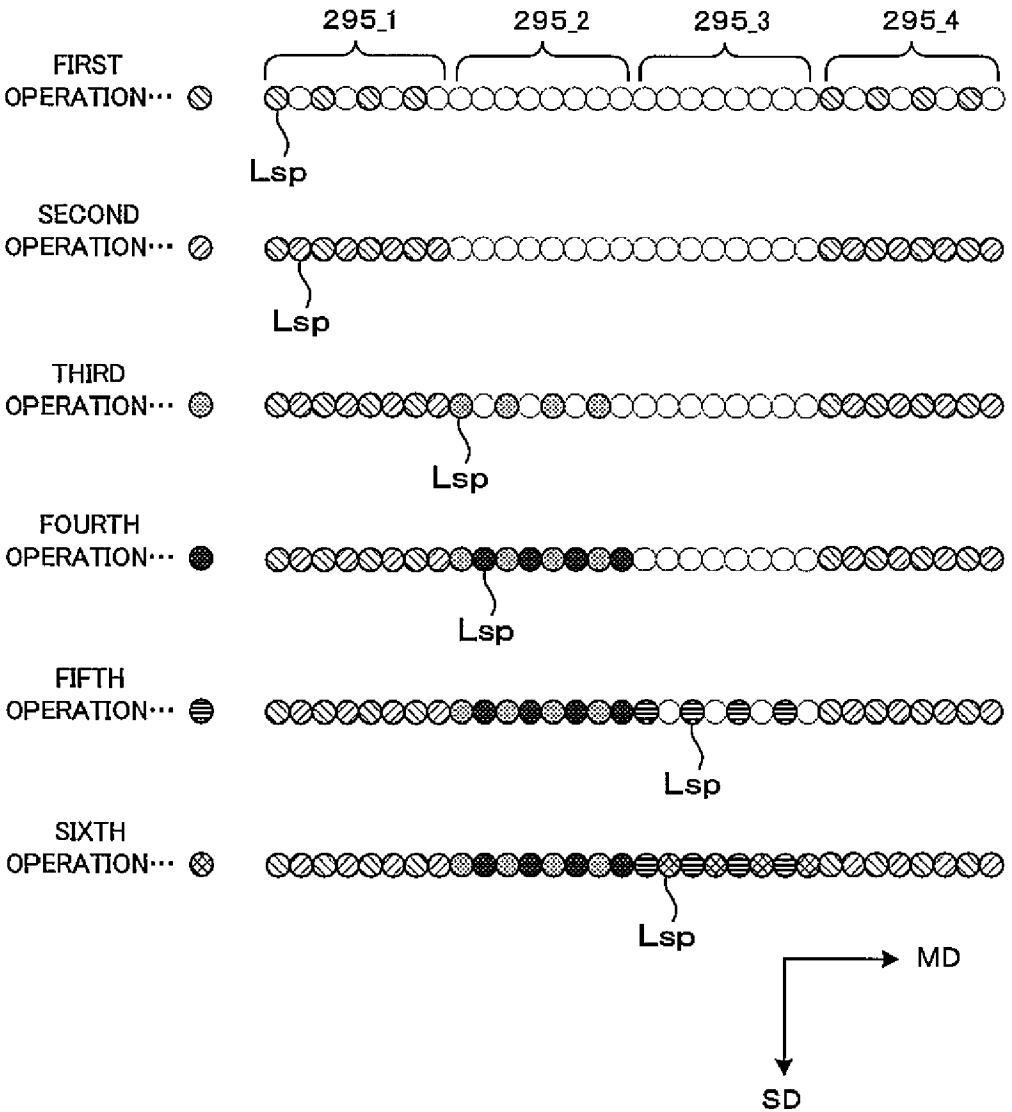
FIG. 14 is a diagram showing a spot forming operation by the above line head.

FIG. 14 is a diagram showing a spot forming operation by the above line head. The spot forming operation by the line head is described with reference to FIGS. 7, 13 and 14. Briefly, the photosensitive drum surface (latent image carrier surface) is moved in the sub scanning direction SD and the head control module 54 (FIG. 4) drives the light emitting elements 2951 for light emission at timings in conformity with the movement of the photosensitive drum surface, whereby a plurality of spot latent images Lsp arranged in the main scanning direction MD are formed.

First of all, out of the light emitting element rows 2951R (FIG. 13) belonging to the most upstream light emitting element groups 295_1, 295_4, and the like in the width direction LTD, the light emitting element rows 2951R downstream in the width direction LTD are driven for light emission. A plurality of light beams emitted by such a light emitting operation are imaged by the lenses LS to form spots SP on the photosensitive drum surface. The lenses LS have an inversion characteristic, so that the light beams from the light emitting elements 2951 are imaged in an inverted manner. In this way, spot latent images Lsp are formed at hatched positions of a "First Operation" of FIG. 14. In FIG. 14, white circles represent spots that are not formed yet, but planned to be formed later. In FIG. 14, spots labeled by reference numerals 295_1 to 295_4 are those to be formed by the light emitting element groups 295 corresponding to the respective attached reference numerals.

Subsequently, out of the light emitting element rows 2951R belonging to the most upstream light emitting element groups 295_1, 295_4, and the like in the width direction, the light emitting element rows 2951R upstream in the width direction LTD are driven for light emission. A plurality of light beams emitted by such a light emitting operation are imaged by the lenses LS to form spots SP on the photosensitive drum surface. In this way, spot latent images Lsp are formed at hatched positions of a "Second Operation" of FIG. 14. Here, the light emitting element rows 2951R are successively driven for light emission from the one downstream in the width direction LTD in order to deal with the inversion characteristic the imaging optical system has.

Subsequently, out of the light emitting element rows 2951R belonging to the second most upstream light emitting element groups 295_2 and the like in the width direction, the light emitting element rows 2951R downstream in the width direction LTD are driven for light emission. A plurality of light beams emitted by such a light emitting operation are imaged by the lenses LS to form spots SP on the photosensitive drum surface. In this way, spot latent images Lsp are formed at hatched positions of a "Third Operation" of FIG. 14.

Subsequently, out of the light emitting element rows 2951R belonging to the second most upstream light emitting element groups 295_2 and the like in the width direction, the light emitting element rows 2951R upstream in the width direction LTD are driven for light emission. A plurality of light beams emitted by such a light emitting operation are imaged by the lenses LS to form spots SP on the photosensitive drum surface. In this way, spot latent images Lsp are formed at hatched positions of a "Fourth Operation" of FIG. 14.

Subsequently, out of the light emitting element rows 2951R belonging to the second most upstream light emitting element groups 295_2 and the like in the width direction, the light emitting element rows 2951R downstream in the width direction LTD are driven for light emission. A plurality of light beams emitted by such a light emitting operation are imaged by the lenses LS to form spots SP on the photosensitive drum surface. In this way, spot latent images Lsp are formed at hatched positions of a "Third Operation" of FIG. 14.

Finally, out of the light emitting element rows 2951R belonging to the third most upstream light emitting element groups 295_3 and the like in the width direction, the light emitting element rows 2951R upstream in the width direction LTD are driven for light emission. A plurality of light beams emitted by such a light emitting operation are imaged by the lenses LS to form spots SP on the photosensitive drum surface. In this way, spot latent images Lsp are formed at hatched positions of a "Sixth Operation" of FIG. 14. By performing the first to sixth light emitting operations in this way, a plurality of spots SP are successively formed from the upstream ones in the sub scanning direction SD to form a plurality of spot latent images Lsp aligned in the main scanning direction MD.

As described above, in this embodiment, the first lens LS1 is the multifocal lens having a plurality of focal points with mutually different focal lengths. Specifically, the lens surface LSF of the first lens has a plurality of areas LR and the positions of the focal points FP of the plurality of respective areas LR differ from each other in the light beam propagation direction Doa. Accordingly, the respective lights incident on the respective areas LR are imaged at the imaging positions IFP1 to IFP3 different from each other in the light beam propagation direction Doa (FIG. 10). Thus, even if the position of the photosensitive drum surface varies in the light beam propagation direction Doa, the variation of the shapes of the spots formed on the photosensitive drum surface by the imaged light beams is suppressed.

The following problems occurred in some cases in the case of using the lens array 299, in which a plurality of lenses LS are two-dimensionally arranged, in the line head 29 as in this embodiment. In other words, since the assembling accuracy of the line head 29 and the image forming apparatus have specified tolerances, the lens array 299 may be mounted while being inclined with respect to the surface of the photosensitive drum 21. In such a case, there is a possibility that distances (work distances) to the surface of the photosensitive drum 21 in the light beam propagation direction Doa differ among the lenses LS. Further, in the case of imaging spots on the surface (circumferential surface) of the cylindrical photosensitive drum 21, the surface of the photosensitive drum 21 has a finite curvature as shown in FIG. 13. In this case, the above distance differences among a plurality of lens rows may possibly occur. Alternatively, in an image forming apparatus using a photosensitive drum, a spot forming operation can be performed while a surface of the photosensitive drum is moved in a sub scanning direction parallel to or substantially parallel to a width direction. Even in such a construction, the above distance differences may possibly occur among a plurality of lens rows due to the eccentricity of the photosensitive drum or other reason. Due to such various causes, distances to the surface of the photosensitive drum 21 in the light beam propagation direction Doa differ among the lens rows LSR, whereby good spots SP may not be formed on the surface of the photosensitive drum 21. One or a plurality of problems described above may occur in a complex manner.

In contract, in this embodiment, spots SP can be satisfactorily formed on the surface of the photosensitive drum 21 even if distances between the lenses LS and the surface of the photosensitive drum 21 differ from a specified value or distances to the surface of the photosensitive drum 21 differ among the lenses LS. This is described with reference to FIG. 10. As shown in FIG. 10, the respective imaging positions IFP are arranged in the light beam propagation direction Doa in the order of IFP2, IFP1 and IFP3. Accordingly, good spots SP can be formed on the photosensitive drum surface as long as the photosensitive drum surface is present in a range (imaging range) of the imaging positions IFP2 to IFP3 or a range including this imaging range and slightly wider than this imaging range.

In other words, if, for example, the first lens LS1 is a single focal lens and the imaging optical system has only a single imaging position IFP1, spots SP become larger and blur if the photosensitive drum surface deviates from the imaging position IFP1. In contrast, the blurring of spots SP caused by the variation of the photosensitive drum surface position is suppressed in this embodiment in which the first lens LS1 is a multifocal lens having a plurality of focal points with mutually different focal lengths and the imaging optical system has a plurality of imaging positions IFP. This is because good spots SP can be formed by light beams imaged at the imaging position IFP2 if the surface of the photosensitive drum 21 approaches the lens array 299 and good spots SP can be formed by light beams imaged at the imaging position IFP3 if the photosensitive drum surface moves away from the lens array 299.

In this way, since the first lenses LS1 are the multifocal lenses each having a plurality of focal points with mutually different focal lengths in this embodiment, good spots can be formed even if a distance (work distance) between the surface of the photosensitive drum 21 and the lens array 299 varies. Thus, even if the work distances differ among a plurality of lens rows LSR for the various reasons described already, there are no large differences in the shapes of spots SP formed by the respective lens rows LSR and good spots SP can be formed on the photosensitive drum surface.

The application of the invention is particularly preferable in the case where the light emitting element groups 295 are configured as shown in FIG. 8 as in this embodiment. In other words, light beams emitted from the light emitting element groups 295 are incident on the surface of the photosensitive drum 21 at a specified field angle after being imaged by the imaging optical systems. However, a plurality of light emitting elements 2951 are arranged in the longitudinal direction LGD in each light emitting element group 295 as shown in FIG. 8. Accordingly, light beams emitted from the light emitting elements 2951 (end light emitting elements) at the ends in the longitudinal direction LGD are incident on the surface of the photosensitive drum 21 at relatively large field angles. Thus, spots formed by the light beams from the end light emitting elements are subject to the variation of the work distance. In contrast in the case of applying the invention, the variation of spots SP in response to the variation of the work distance can be suppressed and good spot formation can be realized.

Since the plurality of focal points FP1 to FP3 of the first lens LS1 are arranged linearly or substantially linearly in the light beam propagation direction Doa in this embodiment, better spots SP can be formed on the photosensitive drum surface. This is described. If the focal points FP1 to FP3 are arranged in a zigzag manner without being arranged linearly or substantially linearly in the light beam propagation direction Doa, the imaging positions IFP1 to IFP3 are also arranged in a zigzag manner. Here is thought a case where the imaging position IFP2 is displaced in the longitudinal direction LGD (or width direction LTD) with respect to the first imaging position IFP1 in FIG. 10. In this case, the spots SP formed by the first light beams LB1 and the spots SP formed by the second light beams LB2 are located at positions different in the longitudinal direction LGD (or width direction LTD). Accordingly, if the position of the photosensitive drum surface varies in the light beam propagation direction Doa, the formation positions of the spots SP vary in the longitudinal direction LGD (or width direction LTD). In contrast, since the plurality of focal points FP1 to FP3 are linearly or substantially linearly arranged in the light beam propagation direction Doa in this embodiment, the imaging positions IFP1 to IFP3 are also linearly or substantially linearly arranged in the light beam propagation direction Doa. Thus, independently of the variation of the position of the photosensitive drum surface, the formation positions of the spots SP can be substantially constant in the longitudinal direction LGD and the width direction LTD, which makes it possible to realize a better spot forming operation.

In this embodiment, one (first area LR1) of the plurality of areas LR is a circular area, and the areas (second area LR2, third area LR3) other than the one area are ring-shaped areas surrounding the circular area and concentric with the circular area. Accordingly, the shape of the lens surface LSF of the first lens LS1 is rotationally symmetrical with respect to the centers of the circular area and the ring-shaped areas. Thus, the lens LS1 can be easily constructed and the simplification of the construction of the lens array 299A and the cost reduction thereof can be realized.

As described above, in this embodiment, uniform spots SP can be formed independently of differences in the work distance among the plurality of lens rows LSR. In other words, the respective lenses LS can be constructed without considering the work distance differences among the plurality of lens rows LSR. Utilizing this advantage, the lens array 299A is constructed such that the respective lenses LS thereof have an identical construction. In other words, this embodiment is preferable since the simplification of the construction of the lens arrays 299 and the cost reduction thereof can be realized.

C. MISCELLANEOUS

As described above, in this embodiment, the longitudinal direction LGD and the main scanning direction MD correspond to a "first direction" of the invention, the width direction LTD and the sub scanning direction SD correspond to a "second direction" of the invention and the light beam propagation direction Doa corresponds to a "third direction". The lens array 299A corresponds to a "lens array for line head" of the invention. The first lenses LS1 constituting the lens array 299A correspond to "lenses" of the invention, and one of two lenses LS1 arranged in the longitudinal direction LGD corresponds to a "first positive lens" of the invention and the other to a "second positive lens" of the invention. Further, the photosensitive drum 21 corresponds to a "latent image carrier" of the invention, and the surface thereof to a "surface of the latent image carrier" or "specified plane" of the invention.

The invention is not limited to the above embodiments and various changes other than the above can be made without departing from the gist thereof. For example, in the above embodiments, four light emitting elements 2951 are aligned in the longitudinal direction LGD in each light emitting element row 2951R, and two light emitting element rows 2951R are arranged in the width direction LTD in each light emitting element group 295. However, the number of the light emitting elements 2951 constituting the light emitting element row 2951R and the number of the light emitting element rows 2951R constituting the light emitting element group 295 are not limited to these. Accordingly, the light emitting element group 295 can be configured as described below.

Figure 15:
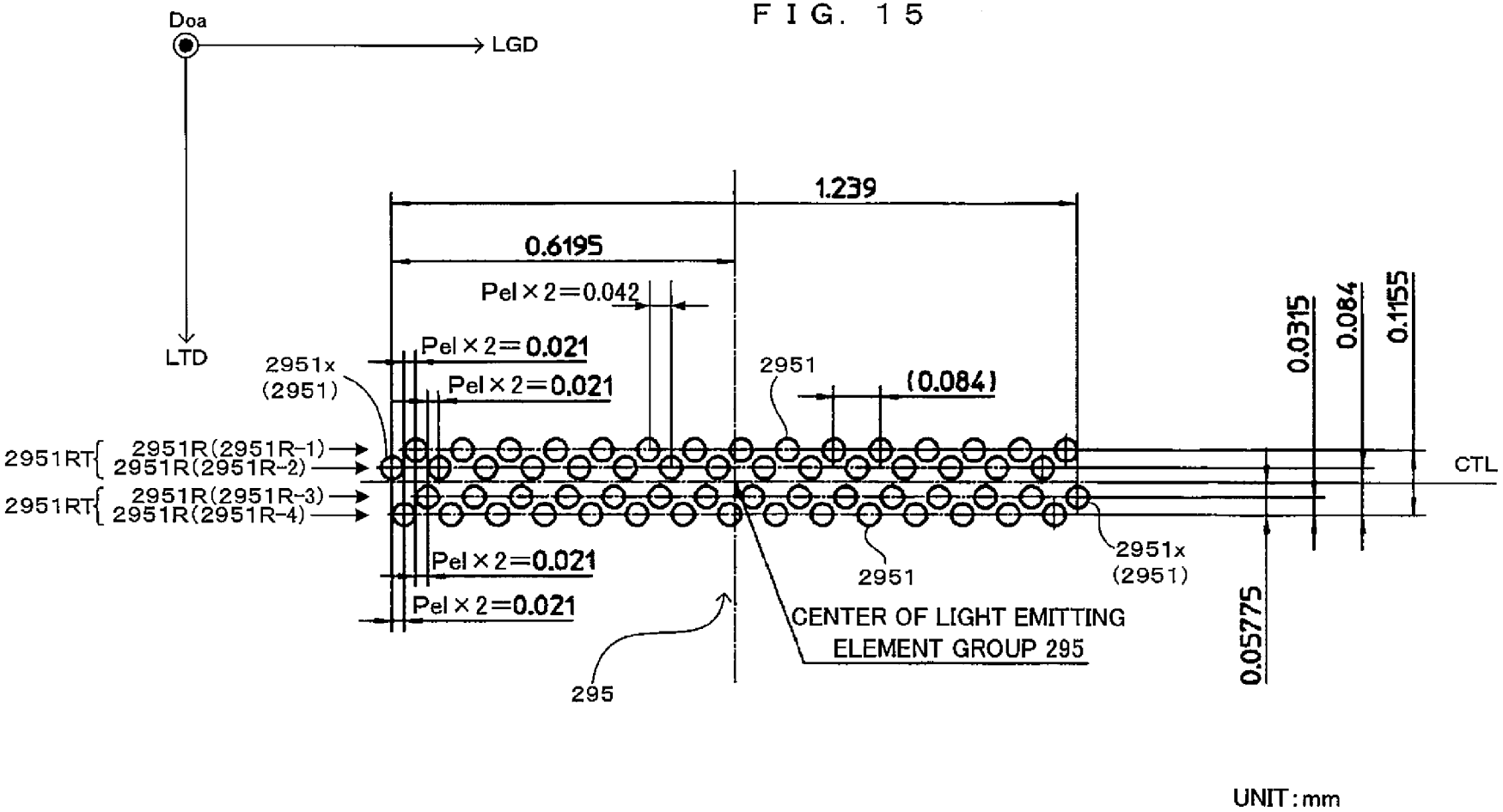
FIG. 15 is a plan view showing other structure of the light emitting element groups.
Figure 16:
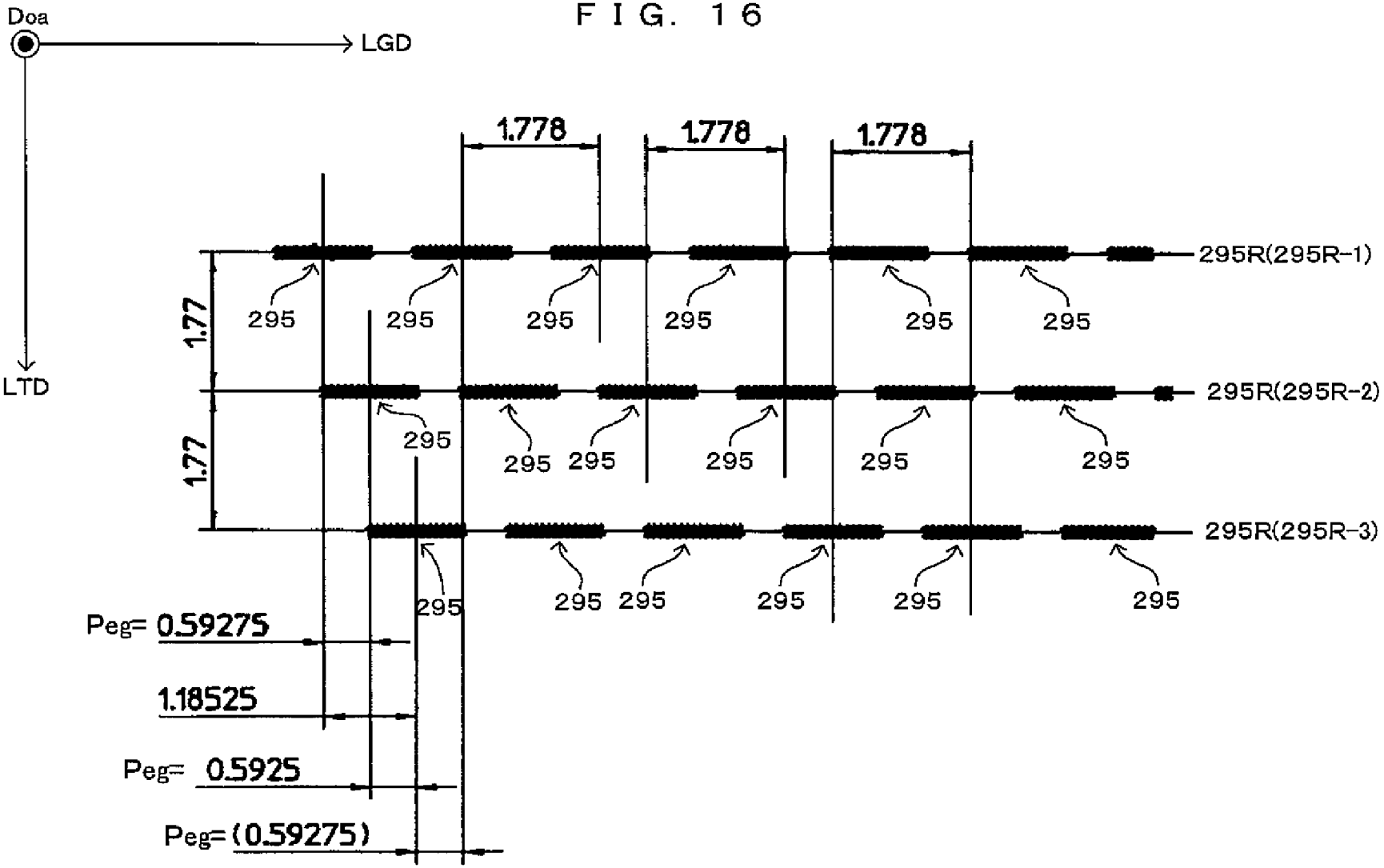
FIG. 16 is a view showing the structure of the under surface of the head substrate on which the plurality of light emitting element groups shown in FIG. 15 are arranged.

FIG. 15 is a plan view showing other structure of the light emitting element groups. FIG. 16 is a view showing the structure of the under surface of the head substrate on which the plurality of light emitting element groups shown in FIG. 15 are arranged and corresponds to a case where the under surface is viewed from the top surface of the head substrate. In the structure shown in FIG. 15, fifteen light emitting elements 2951 are arranged side by side in the longitudinal direction LGD to form the light emitting element rows 2951R. In the light emitting element rows 2951R, the light emitting elements 2951 are arranged at pitches (=0.084 [mm]) which are four times as large as the element pitches Pel (=0.021 [mm]). Four such light emitting element rows 2951R (2951R-1, 2951R-2, 2951R-3, 2951R-4) are arranged in the width direction LTD. In the width direction LTD, the pitch between the light emitting element row 2951R-4 and the light emitting element row 2951R-1 is 0.1155 [mm], the pitch between the light emitting element row 2951R-4 and the light emitting element row 2951R-2 is 0.084 [mm], and the pitch between the light emitting element row 2951R-4 and the light emitting element row 2951R-3 is 0.0315 [mm]. Further, when a straight line which is parallel to the longitudinal direction LGD and passes through the center (of gravity) of the light emitting element group 295 is a center line CTL, the pitch in the width direction LTD between the light emitting element row 2951R-1 and the center line CTL and that between the light emitting element row 2951R-4 and the center line CTL are 0.05775 [mm], respectively.

In FIG. 15, the two light emitting element rows 2951R-1 and 2951R-2 above the center line CTL constitute a light emitting element set 2951RT and the two light emitting element rows 2951R-3 and 2951R-4 below the center line CTL constitute a light emitting element set 2951RT. In each light emitting element set 2951RT, two light emitting element rows 2951R are shifted from each other in the longitudinal direction LGD by a pitch (=0.042 [mm]) which is twice as large as the element pitch Pel (=0.021 [mm]). Further, the two light emitting element sets 2951RT are shifted from each other in the longitudinal direction LGD by the element pitch Pel (=0.021 [mm]). Hence, the four light emitting element rows 2951R are shifted from each other in the longitudinal direction LGD by the element pitches Pel (=0.021 [mm]). As a result, the positions of the light emitting elements 2951 in the longitudinal direction LGD are different. When the light emitting elements 2951 at the both ends of the light emitting element groups 295 in the longitudinal direction LGD are called end light emitting elements 2951*x*, the pitch between the end light emitting elements 2951*x* in the longitudinal direction LGD is 1.239 [mm] and the pitch between the end light emitting element 2951*x* and the center of the light emitting element group 295 in the longitudinal direction LGD is 0.6195 [mm].

In the embodiment shown in FIG. 16, the light emitting element groups 295 shown in FIG. 15 are two-dimensionally arranged. As shown in FIG. 16, the plurality of light emitting element groups 295 are arranged in the longitudinal direction LGD to form the light emitting element group rows 295R. In the light emitting element group rows 295R, the light emitting element groups 295 are arranged at pitches (=1.778 [mm]) which are triple as large as the light emitting element group pitches Peg. Three light emitting element group rows 295R (295R-1, 295R-2, 295R-3) structured in this way are arranged in the width direction LTD at the light emitting element group row pitches Pegr (=1.77 [mm]). The light emitting element group rows 295R are shifted from each other in the longitudinal direction LGD by the light emitting element group pitches Peg (which are about 0.593 [mm]). That is, the light emitting element group row 295R-1 and the light emitting element group row 295R-2 are shifted from each other in the longitudinal direction LGD by 0.59275 [mm], the light emitting element group row 295R-2 and the light emitting element group row 295R-3 are shifted from each other in the longitudinal direction LGD by 0.5925 [mm], and the light emitting element group row 295R-3 and the light emitting element group row 295R-1 are shifted from each other in the longitudinal direction LGD by 0.59275 [mm]. Hence, the light emitting element group row 295R-1 and the light emitting element group row 295R-3 are shifted from each other in the longitudinal direction LGD by 1.18525 [mm].

In the above embodiments, three lens rows LSR are arranged in the width direction LTD. However, the number of the lens rows LSR is not limited to three and the invention is applicable to constructions with one or more lens rows LSR. For example, an embodiment with one lens row LSR is described with reference to FIGS. 17 and 18.

Figure 17:
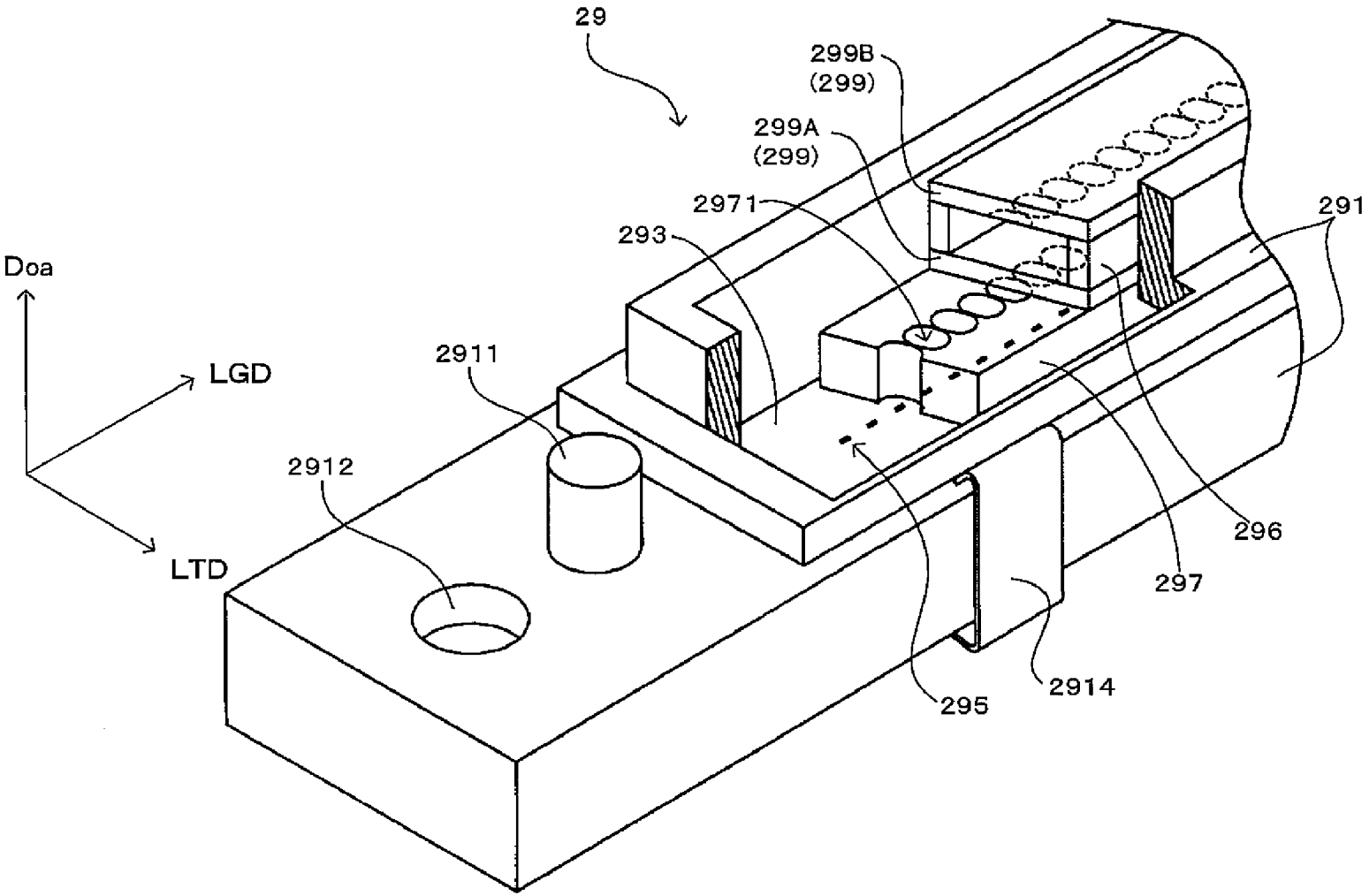
FIG. 17 is a perspective view showing another embodiment of the line head according to the invention.
Figure 18:
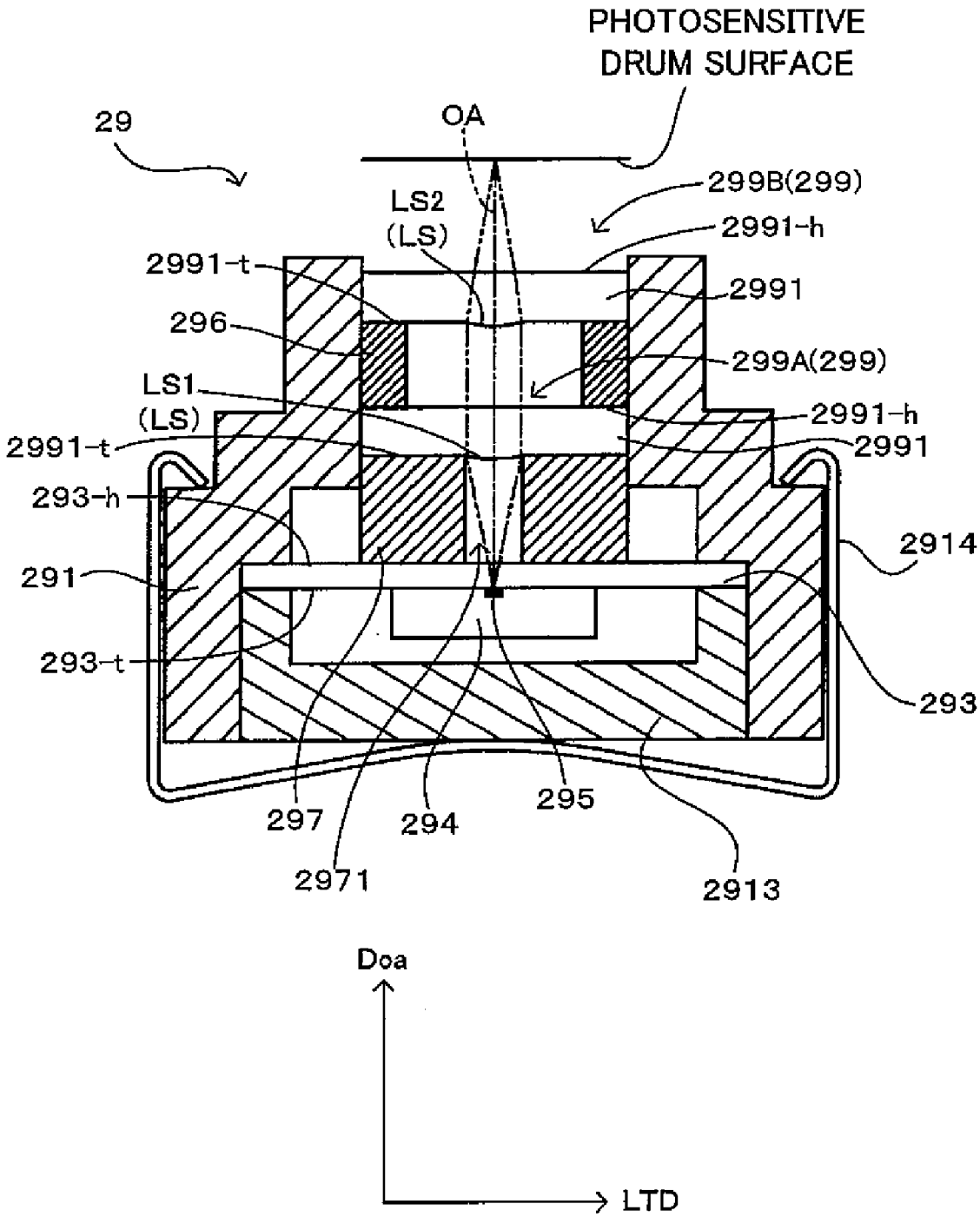
FIG. 18 is a partial sectional view in the width direction of the line head of FIG. 17 showing the section parallel to the optical axis of the lens.

FIG. 17 is a perspective view showing another embodiment of the line head according to the invention. FIG. 18 is a partial sectional view in the width direction of the line head of FIG. 17 showing the section parallel to the optical axis OA of the lens LS. Only points of difference between the above embodiment described with reference to FIG. 5 and other figures and this embodiment are mainly described below, and common points are identified by equivalent reference numerals and are not described.

In this embodiment as well, a head substrate 293 having light emitting element groups 295 arranged thereon is provided and two lens arrays 299A, 299B are arranged in the light beam propagation direction Doa. A plurality of light emitting element groups 295 are aligned in the longitudinal direction LGD on the head substrate 293. In each of the lens arrays 299A, 299B, a lens LS is provided for each light emitting element group 295 and a plurality of lenses LS are aligned at lens pitches Pls in the longitudinal direction LGD to form one lens row LSR. In this embodiment, the lenses LS are formed on an under surface 2991-*t* of a lens array substrate 2991 in each of the lens arrays 299A, 299B.

Also in a line head 29 employing the lens arrays each having the lenses LS aligned in a row, there is a possibility that distances (work distances) to the surface of the photosensitive drum 21 in the light beam propagation direction Doa differ among the lenses LS similar to the above embodiment, when the lens arrays 299 are mounted while being inclined with respect to the surface of the photosensitive drum 21, for example. However, by applying the invention to this embodiment, that is, by employing such a construction that lens surfaces of the lenses LS are free-form surfaces and have a plurality of focal points with mutually different focal lengths, the formation positions of spots SP can be substantially constant independently of the position of the surface of the photosensitive drum 21, and a better spot forming operation can be realized.

In the above embodiments, the multifocal lenses LS1 having a plurality of focal points with mutually different focal lengths are formed by forming the lenses LS on the under surface 2991-*t* of the lens array substrate. However, the lens array 299A may be formed by forming multifocal lenses LS1 having a plurality of focal points with mutually different focal lengths on the top surface 2991-*h* of the lens array substrate 2991.

Further, although the first lens LS1 is the multifocal lens having a plurality of focal points with mutually different focal lengths out of the plurality of lenses LS constituting the imaging optical system in the above embodiments, the second lens LS2 may be a multifocal lens. However, in the case of arranging a diaphragm on the optical axis OA as in an example to be described later (FIGS. 19 and 20), a lens surface located closer to an image side (closer to the surface of the photosensitive drum 21) than the diaphragm, particularly a lens surface closest to the diaphragm at the image side, preferably has a plurality of focal points with mutually different focal lengths.

Although the lens LS1 has three focal points in the above embodiments, the number of the focal points of the lens LS1 is not limited to three and it is sufficient for the lens LS1 to have two or more focal points. In other words, a lens having a plurality of focal points with mutually different focal lengths can be used as a multifocal lens.

In the above embodiments, the first lens LS1 has the shape rotationally symmetrical with respect to the optical axis OA. However, it is not an essential feature of the invention that the shape of the first lens LS1 is rotationally symmetrical with respect to the optical axis OA.

Further, although the two lens arrays 299 are used in the above embodiments, the number of the lens arrays 299 is not limited to this.

In the above embodiments, the lenses LS are formed on the lens array substrate 2991 to form the lens array 299. In other words, the lens array substrate 2991 and the lenses LS are separately formed. However, the lens array substrate 2991 and the lenses LS can be integrally formed of the same material.

Although the respective lenses LS1 of the lens array 299A have an identical construction in the above embodiments, it is not an essential feature of the invention to identically construct these lenses LS1. Thus, the respective lenses LS1 may be formed to have different constructions.

In the above embodiments, organic EL devices are used as the light emitting elements 2951. However, the devices other than the organic EL devices may be used as the light emitting elements 2951. For example, LEDs (light emitting diodes) may be used as the light emitting elements 2951.

In an embodiment according to an aspect of the invention, the lens array may be constructed such that a lens different from the first positive lens and the second positive lens is arranged in a second direction orthogonal to or substantially orthogonal to a first direction in which the first and second positive lenses are arranged. By two-dimensionally arranging the lenses in this way, spots can be densely imaged on a specified plane, which makes it possible to perform an exposure process at a higher resolution.

Further, the lens array for line head may be constructed such that the first and second positive lenses have the lens surfaces of the same lens shape. This is because it can realize the simplification of the construction of the lens array for line head and the cost reduction thereof.

The first and second positive lenses may be made of a light curing resin. In other words, the light curing resin is cured upon light irradiation. Accordingly, by making the lenses of this light curing resin, the lens array for line head can be easily produced, and hence, the cost of the lens away for line head can be suppressed.

Further, the first and second positive lenses may be formed on a glass substrate. That is, the coefficient of linear expansion of glass is relatively small. Therefore, by forming the first and second positive lenses on the glass substrate, it is possible to suppress deformation of the lens array caused by a temperature change and to realize excellent exposure independently of the temperature.

D. EXAMPLES

Next, examples of the invention are described, but the invention is not restricted by the following examples and can be, of course, embodied by being appropriately changed within the scope conformable to the gist described above and below. Any of these examples are embraced by the technical scope of the invention.

Figure 19:
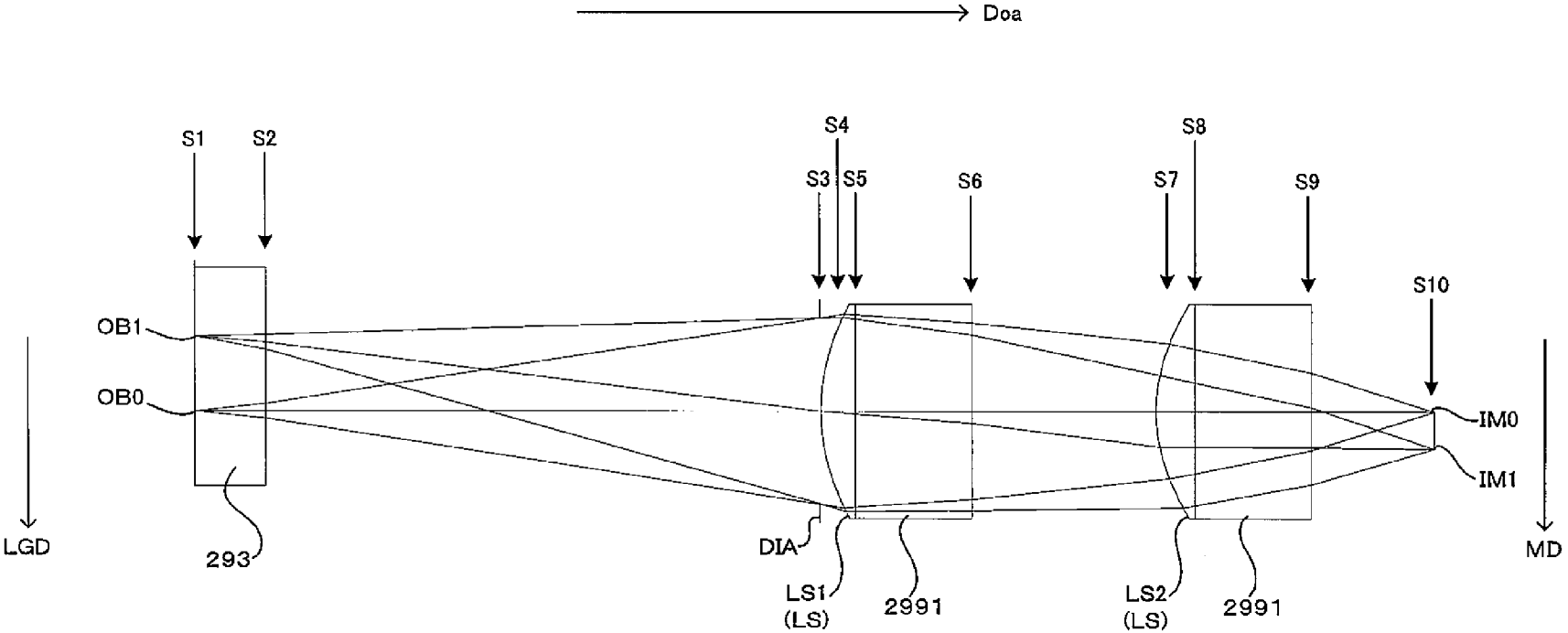
FIG. 19 is a sectional view in the main scanning direction showing an imaging optical system according to an example.

FIG. 19 is a sectional view in the main scanning direction MD showing an imaging optical system according to an example. In this example, a diaphragm DIA is provided before a first lens LS1 in the light beam propagation direction Doa and light beams narrowed down by the diaphragm DIA are incident on the first lens LS1. In FIG. 19 are shown an optical path of a light beam emitted from an object point OB0 on an optical axis OA and imaged at an image point IM0 and an optical path of a light beam emitted from an object point OB1 different from the optical axis OA and imaged at an image point IM1. The construction other than the diaphragm DIA is substantially similar to those shown in the first and other embodiments, and optical systems including the respective lenses LS are arranged such that three lenses LS are arranged in a direction A-A line shown in FIG. 5 and other figures to form a lens column.

Figure 20:
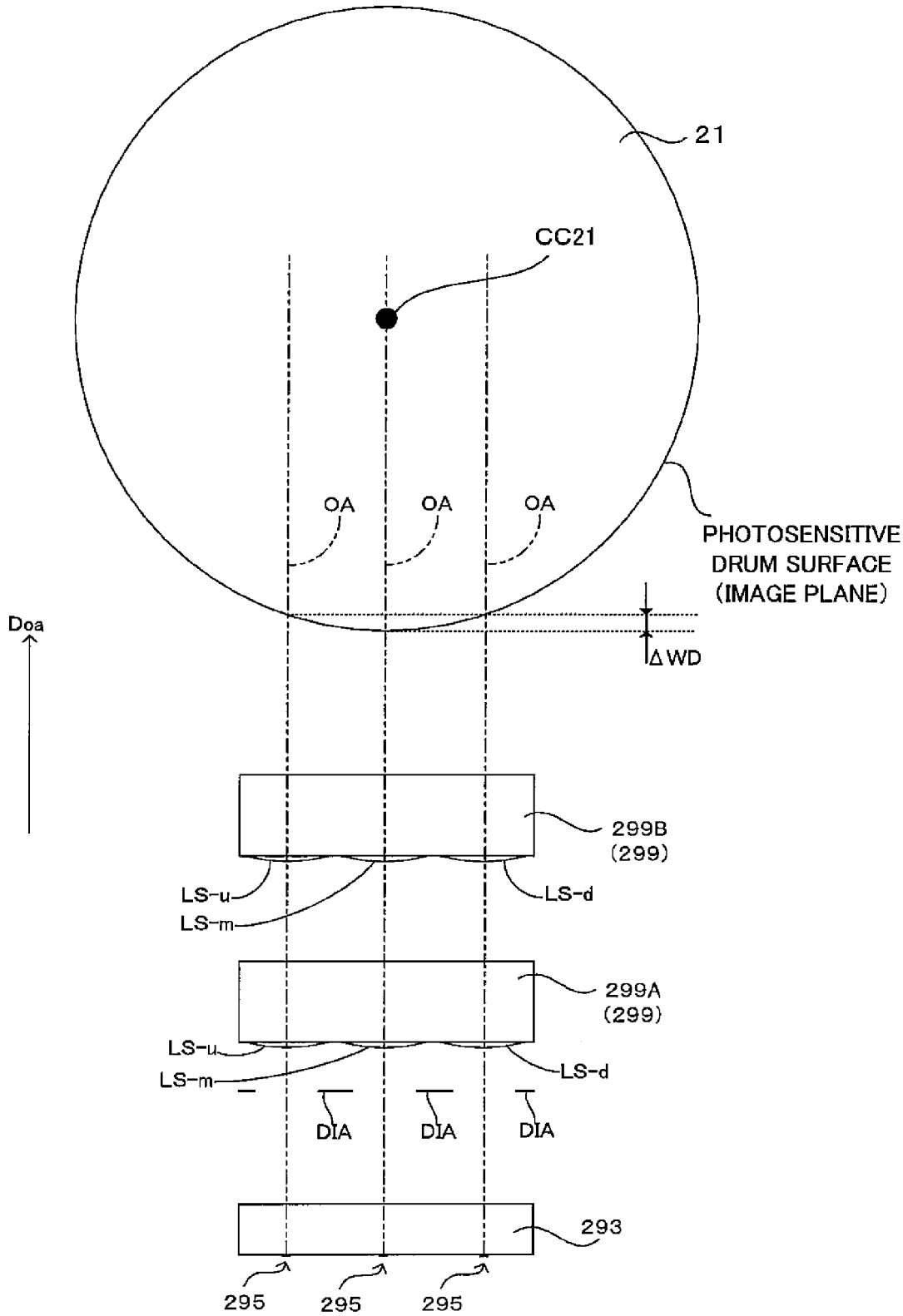
FIG. 20 is a partial sectional view taken on line A-A of a line head and a photosensitive drum according to this example.

FIG. 20 is a partial sectional view taken on line A-A of a line head and a photosensitive drum according to this example. As shown in FIG. 20, the line head made up of light emitting element groups 295, diaphragms DIA, and lens arrays 299A, 299B is arranged to face a photosensitive drum 21. This photosensitive drum 21 has a substantially cylindrical shape centered on an axis of rotation CC21, and a surface thereof has a finite curvature.

In this example, the respective optical systems are arranged at equal pitches in a lateral direction of FIG. 20 and optical axes OA of the optical systems including the middle lenses LS-m pass through the axis of rotation CC21 of the photosensitive drum 21. In the example shown in FIG. 20, work distances are equal to each other between the optical systems including the upstream lenses LS-u and those including the downstream lenses LS-d. On the other hand, the work distances in the light beam propagation direction Doa differ just by a distance ΔWD between the optical systems including the upstream lenses LS-u (or the downstream lenses LS-d) and those including the middle lenses LS-m. Accordingly, as shown by the following data, the optical systems including the lenses LS-u, LS-d and those including the lenses LS-m are differently constructed in this example.

FIG. 21 is a table showing optical system specifications in this example. As shown in FIG. 21, the wavelength of light beams emitted from the light emitting elements is 690 [nm]. Further, the diameter of the photosensitive member is 40 [mm]. FIG. 22 is a table showing data of the optical system including the middle lens, wherein the unit of the surface spacing is [mm]. In the optical system including the middle lens LS-m, a lens surface (surface number S4) of the first lens LS1 is divided into three areas LR1, LR2 and LR3 similar to those shown in FIG. 11. The respective areas LR1 to LR3 are aspherical surfaces. FIG. 23 is a diagram showing a definition formula of the aspherical surface. The lens surface shape of the first lens LS1 is given by the definition formula shown in FIG. 23 and coefficients shown in FIG. 25. A lens surface (surface number S7) of the second lens LS2 is a free-form surface (XY polynomial surface). FIG. 24 is a diagram showing a definition formula for the XY polynomial surface. The lens surface shape of the second lens LS2 is given by the definition formula shown in FIG. 24 and coefficients shown in FIG. 26. Here, FIG. 25 is a table showing coefficient values of the surface S4 of the optical system including the middle lens, wherein the respective coefficients of the first, second and third areas LR1, LR2 and LR3 are shown. Further, FIG. 26 is a table showing coefficient values of the surface S7 of the optical system including the middle lens.

FIG. 27 is a table showing data of the optical systems including the upstream and downstream lenses, wherein the unit of the surface spacing is [mm]. As shown in FIG. 27, also in the optical system including the upstream or downstream lens LS-u or LS-d, the lens surface (surface number S4) of the first lens LS1 is divided into three areas LR1, LR2 and LR3 similar to those shown in FIG. 11. The respective areas LR1 to LR3 are aspherical surfaces, and the lens surface shape of the first lens LS1 is given by the definition formula shown in FIG. 23 and coefficients shown in FIG. 28. The lens surface (surface number S7) of the second lens LS2 is a free-form surface (XY polynomial surface) and the lens surface shape of the second lens LS2 is given by the definition formula shown in FIG. 24 and coefficients shown in FIG. 29. Here, FIG. 28 is a table showing coefficient values of the surfaces S4 of the optical systems including the upstream and downstream lenses, wherein the respective coefficients of the first, second and third areas LR1, LR2 and LR3 are shown. Further, FIG. 29 is a table showing coefficient values of the surfaces S7 of the optical systems including the upstream and downstream lenses.

As described above, the lens surface of the first lens LS1 of each imaging optical system has the first to third areas LR1 to LR3 and the respective areas LR1 to LR3 have mutually different focal points. Thus, the imaging optical systems of this example have the following imaging characteristic.

Figure 30:
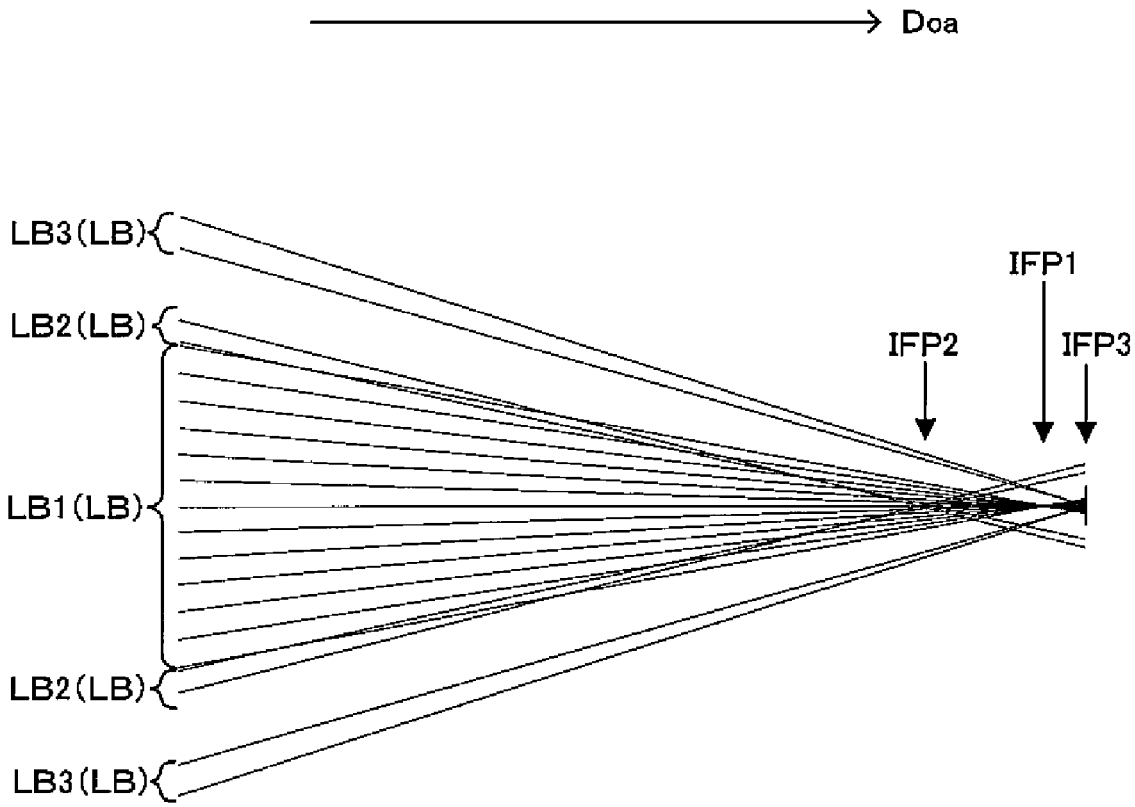
FIG. 30 is a diagram showing the vicinity of imaging positions of the imaging optical system according to this example.

FIG. 30 is a diagram showing the vicinity of imaging positions of the imaging optical system according to this example. As shown in FIG. 30, first light beams LB1 incident in the first area LR1 are imaged at an imaging position IFP1, second light beams LB2 incident in the second area LR2 are imaged at an imaging position IFP2 and third light beams LB3 incident in the third area LR3 are imaged at an imaging position IFP3. The imaging positions IFP1 to IFP3 are arranged linearly or substantially linearly in the light beam propagation direction Doa. Thus, as shown in FIG. 31 to be described next, the variation of the sizes of spots in response to the variation of the photosensitive drum surface position in the light beam propagation direction Doa is suppressed.

Figure 31:
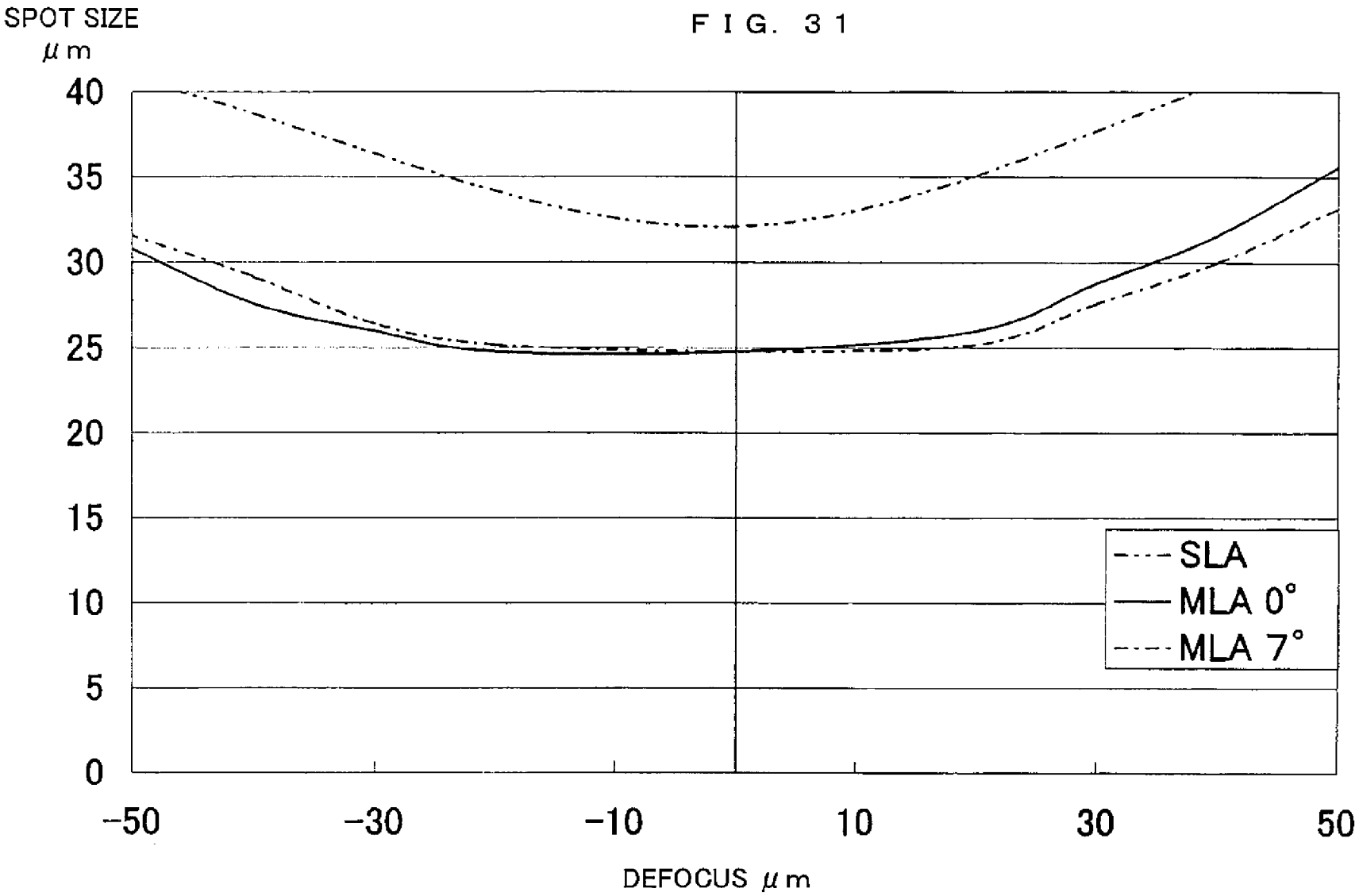
FIG. 31 is a graph showing the sizes of spots formed by the imaging optical system of this example.

FIG. 31 is a graph showing the sizes of spots (spot sizes) formed by the imaging optical system of this example. "Defocus" represented by a horizontal axis of FIG. 31 corresponds to a variation amount of the photosensitive drum surface in the light beam propagation direction Doa and a vertical axis represents the spot size. In other words, FIG. 31 shows a change of the spot size in response to the variation of the photosensitive drum surface. A curve identified by "SLA" in FIG. 31 shows the size of a spot formed by an imaging optical system using a gradient index lens so-called SLA (registered trademark of Nippon Sheet Glass Co., Ltd.) as a lens. A curve identified by "MLA 0 degree" of FIG. 31 shows an imaging characteristic of the imaging optical system of this example, wherein the size of a spot formed by an imaged light beam having a field angle of 0 degree is shown. A curve identified by "MLA 7 degree" of FIG. 31 shows an imaging characteristic of the imaging optical system of this example, wherein the size of a spot formed by an imaged light beam having a field angle of 7 degrees is shown. As shown in FIG. 31, in the imaging optical system using the SLA, the spot size varies by 3 [μm] due to a defocus variation of ±15 [μm]. On the other hand, in the imaging optical system of this example, it can be understood that the spot size is substantially constant independently of the field angle of the imaged light beam even if the defocus varies by ±15 [μm]. In this way, this example is preferable since the variation of the spot size in response to the variation of the photosensitive drum surface position can be suppressed.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. A line head, comprising:

a head substrate that includes a first light emitting element and a second light emitting element; and a lens array that includes a first positive lens imaging a light from the first light emitting element at a first imaging position and a second imaging position different from the first imaging position in a direction of an optical axis, and a second positive lens imaging a light from the second light emitting element at a third imaging position and a fourth imaging position different from the third imaging position in a direction of the optical axis.

2. An image forming apparatus, comprising:

a head substrate that includes a first light emitting element and a second light emitting element; and a lens array that includes a first positive lens imaging a light from the first light emitting element at a first imaging position and a second imaging position different from the first imaging position in a direction of an optical axis, and a second positive lens imaging a light from the second light emitting element at a third imaging position and a fourth imaging position different from the third imaging position in a direction of the optical axis, a latent image carrier on which a latent image is formed by the light imaged by the first positive lens and the light imaged by the second positive lens.

3. The image forming apparatus according to claim 2, wherein the lens array includes a third lens that is different from the first positive lens and the second positive lens, the first positive lens and the second positive lens are arranged in a first direction, and the third lens is arranged relative to the first and the second positive lenses in a second direction orthogonal to or substantially orthogonal to the first direction.

4. The image forming apparatus according to claim 2, wherein lens surfaces of the first and the second positive lenses are identically shaped.

5. The image forming apparatus according to claim 2, wherein the first and the second positive lenses are made of a light curing resin.

6. The image forming apparatus according to claim 2, wherein the lens array includes a glass substrate on which the first and the second positive lenses are formed.

7. The image forming apparatus according to claim 2, comprising a third positive lens that images the light from the first light emitting element at a first imaging position and a second imaging position with the first positive lens, and a fourth positive lens that images the light from the second light emitting element at a third imaging position and a fourth imaging position with the second positive lens.

8. An image forming apparatus, comprising:

a head substrate that includes a first light emitting element and a second light emitting element;

a first imaging optical system that images a light emitted from the first light emitting element at a first imaging position and a second imaging position different from the first imaging position in a direction of a first optical axis; and a second imaging optical system that images a light emitted from the second light emitting element at a third imaging position and a fourth imaging position different from the third imaging position in a direction of a second optical axis, wherein the first optical axis of the first imaging optical system and the second optical axis of the second imaging optical system are parallel or substantially parallel.

* * * * *